US010655439B2

(12) United States Patent
Murdoch et al.

(10) Patent No.: US 10,655,439 B2
(45) Date of Patent: May 19, 2020

(54) GAS LIFT METHOD AND APPARATUS

(71) Applicant: Weatherford U.K. Limited, Leicestershire (GB)

(72) Inventors: Euan Murdoch, Aberdeenshire (GB); Colin Gordon Rae, Aberdeen (GB); Richard Alastair Howard Dalzell, Angus (GB); Matthew Knight, Aberdeenshire (GB); Quentin Lhussier, Balmedie (GB)

(73) Assignee: Weatherford U.K. Limited (GB)

( * ) Notice: Subject to any disclaimer, the term of this patent is extended or adjusted under 35 U.S.C. 154(b) by 148 days.

(21) Appl. No.: 15/570,840

(22) PCT Filed: May 12, 2016

(86) PCT No.: PCT/GB2016/051369
§ 371 (c)(1),
(2) Date: Oct. 31, 2017

(87) PCT Pub. No.: WO2016/181154
PCT Pub. Date: Nov. 17, 2016

(65) Prior Publication Data

US 2018/0149002 A1 May 31, 2018

(30) Foreign Application Priority Data

May 12, 2015 (GB) ..... 1508103.7
Apr. 19, 2016 (GB) ..... 1606809

(51) Int. Cl.
*E21B 43/12* (2006.01)
*E21B 34/08* (2006.01)
(Continued)

(52) U.S. Cl.
CPC ..... *E21B 43/123* (2013.01); *E21B 34/066* (2013.01); *E21B 44/005* (2013.01);
(Continued)

(58) Field of Classification Search
CPC .... E21B 43/122; E21B 43/123; E21B 34/066; E21B 34/08
See application file for complete search history.

(56) References Cited

U.S. PATENT DOCUMENTS 4,981,118 A 1/1991 Lefebvre
5,172,717 A 12/1992 Boyle et al.
(Continued)

FOREIGN PATENT DOCUMENTS

WO 00/79098 A1 12/2000

OTHER PUBLICATIONS

Int'l Search Report and Written Opinion in co-pending PCT Application No. PCT/GB2016/051369, dated May 12, 2016, 13-pgs.
(Continued)

*Primary Examiner* — Kenneth L Thompson
(74) *Attorney, Agent, or Firm* — Blank Rome, LLP

(57) ABSTRACT

A method for injection of a lift gas into a wellbore production string comprises determining production pressure within the production string, and autonomously controlling a variable orifice gas lift valve in accordance with the determined production pressure, wherein the variable orifice gas lift valve controls the injection flow rate of the lift gas into the production string. A valve comprises a housing defining an inlet, an outlet and a flow path therebetween, and a valve member linearly moveable within the housing between first and second positions to vary flow along the flow path, wherein the valve member is prevented from rotation relative to the housing during linear movement between the first and second positions. The valve further includes a rotary drive and a transmission arrangement interposed between the rotary drive and the valve member for converting rotation of the rotary drive to linear movement of the valve member.

24 Claims, 15 Drawing Sheets

(51) Int. Cl.

| | |
|---|---|
| ***E21B 44/00*** | (2006.01) |
| ***E21B 34/06*** | (2006.01) |
| ***E21B 47/06*** | (2012.01) |
| *E21B 47/12* | (2012.01) |
| *E21B 47/18* | (2012.01) |

(52) U.S. Cl.
CPC ..... *E21B 47/06* (2013.01); *E21B 34/08* (2013.01); *E21B 47/065* (2013.01); *E21B 47/122* (2013.01); *E21B 47/18* (2013.01)

(56) References Cited

U.S. PATENT DOCUMENTS

| | | | | |
|---|---|---|---|---|
| 5,176,164 | A | 1/1993 | Boyle | |
| 5,706,892 | A | 1/1998 | Aeschbacher et al. | |
| 5,803,167 | A | 9/1998 | Bussear et al. | |
| 5,896,924 | A | 4/1999 | Carmody et al. | |
| 5,934,371 | A | 8/1999 | Bussear et al. | |
| 5,937,945 | A | 8/1999 | Bussear et al. | |
| 5,959,547 | A | 9/1999 | Tubel et al. | |
| 5,971,004 | A | 10/1999 | Pringle | |
| 6,070,608 | A | 6/2000 | Pringle | |
| 6,082,455 | A | 7/2000 | Pringle et al. | |
| 6,148,843 | A | 11/2000 | Pringle | |
| 6,206,645 | B1 | 3/2001 | Pringle | |
| 6,231,312 | B1 | 5/2001 | Pringle | |
| 6,286,596 | B1 | 9/2001 | Schnatzmeyer et al. | |
| 6,293,341 | B1 * | 9/2001 | Lemetayer | E21B 43/122 166/250.15 |
| 6,305,402 | B2 | 10/2001 | Pringle | |
| 6,422,312 | B1 | 7/2002 | Delatorre et al. | |
| 6,464,004 | B1 | 10/2002 | Crawford et al. | |
| 6,595,294 | B1 * | 7/2003 | Dalsmo | E21B 43/122 166/250.01 |
| 6,655,659 | B2 | 12/2003 | Burke | |
| 6,840,317 | B2 * | 1/2005 | Hirsch | E21B 17/003 166/250.15 |
| 7,021,388 | B2 * | 4/2006 | Williams | E21B 43/123 166/372 |
| 7,055,592 | B2 | 6/2006 | Bass et al. | |
| 9,234,410 | B2 * | 1/2016 | Lemetayer | E21B 43/00 |
| 10,138,724 | B2 * | 11/2018 | Querales | E21B 47/00 |
| 2002/0029883 | A1 | 3/2002 | Vinegar et al. | |
| 2002/0126021 | A1 * | 9/2002 | Vinegar | E21B 43/122 340/854.3 |
| 2003/0164240 | A1 | 9/2003 | Vinegar et al. | |
| 2005/0149264 | A1 * | 7/2005 | Tarvin | E21B 47/065 702/6 |
| 2005/0199391 | A1 * | 9/2005 | Cudmore | E21B 43/122 166/250.15 |
| 2011/0119037 | A1 | 5/2011 | Rashid et al. | |
| 2011/0180267 | A1 * | 7/2011 | Wildman | E21B 43/123 166/372 |
| 2012/0215364 | A1 * | 8/2012 | Rossi | E21B 43/121 700/281 |
| 2014/0034291 | A1 | 2/2014 | Purkis | |

OTHER PUBLICATIONS

Search and Examination Report in counterpart UK Application No. GB19608318.0, dated Nov. 11, 2016, 9-pgs.

* cited by examiner

GAS LIFT METHOD AND APPARATUS

FIELD

The present invention relates to a downhole gas lift method and apparatus.

BACKGROUND

Hydrocarbon production from some reservoirs may require some level of assistance where the reservoir pressure is insufficient to support natural lift, for example due to depleting reservoir pressure following a period of production, and/or where an operator requires higher flow rates than can be naturally supported. In some cases a fluid may be injected which modifies one or more properties of the reservoir fluid to improve its ability to flow to surface. This might involve injecting a fluid which has the effect of reducing the density of the fluid and thus the weight of the fluid column within the wellbore, enabling or assisting the available pressure to lift the fluid column to surface. This may be achieved by injection of a gas, diluent, foaming agent or the like.

In so called gas-lift applications a gas, such as a hydrocarbon gas, is delivered from surface at high pressure and injected into a production string at one or more locations. In many applications gas is delivered from surface via an annulus surrounding the production string, and enters the production string via specialised completion equipment, such as gas lift mandrels and gas lift valves mounted in the mandrels. The gas lift valve typically functions to permit inward flow of the gas, while preventing or checking any reverse flow.

In some known gas lift valves it may be possible to control a flow orifice within the valve. Examples of such variable orifice valves are disclosed in, for example, U.S. Pat. Nos. 5,896,924, 5,937,945, 6,070,608, 6,148,843, 5,971,004, and 6,082,455.

SUMMARY

An aspect or embodiment relates to a method for controlling fluid flow into a target region, comprising:

- determining a parameter (e.g., pressure) at the target region; and
- controlling a variable orifice valve in accordance with the determined parameter, wherein the variable orifice valve controls the flow rate of the fluid into the target region.

An embodiment or aspect relates to a valve, comprising:

- a valve inlet for communicating with a source of fluid and a valve outlet for communicating with a target region;
- a variable orifice positioned between the valve inlet and valve outlet; and
- a controller configured to receive data associated with a parameter (e.g., pressure) at the target region and to control the variable orifice in accordance with said parameter to control flow rate of the fluid therethrough.

An aspect or embodiment relates to a method for injection of a lift gas into a wellbore production string, comprising controlling, for example autonomously controlling, a variable orifice gas lift valve. The variable orifice gas lift valve may be controlled in accordance with one or more sensed parameters associated with the production string. In one embodiment a sensed parameter may comprise flowing production pressure within the production string. A sensed parameter may comprise a flow rate. A sensed parameter may comprise temperature.

An aspect or embodiment relates to a variable orifice gas lift valve for permitting control of injection of a lift gas into a production string. The variable orifice gas lift valve may comprise or be provided in combination with a controller configured to control, for example autonomously control, the variable orifice gas lift valve. The controller may control the variable orifice gas lift valve in accordance with one or more sensed parameters associated with the production string, such as flowing production pressure, flow rate, temperature or the like. The variable orifice gas lift valve may define a self-optimising gas lift valve.

An aspect or embodiment relates to a method for injection of a lift gas into a wellbore production string, comprising:

- determining production pressure within the production string; and
- controlling a variable orifice gas lift valve in accordance with the determined production pressure, wherein the variable orifice gas lift valve controls the injection flow rate of the lift gas into the production string.

Accordingly, control of the injection flow rate of the lift gas may be provided in accordance with the determined production pressure, for example flowing production pressure, within the production string, for example at or in the region of the point of injection gas into the production string.

Lift gas may enter the production string, under control of the variable orifice gas lift valve, to mix with production fluids within the production string and assist to lift said production fluids to surface, by the known effect of reducing the effective weight of the fluid column within the production string. Accordingly, controlling the variable orifice gas lift valve may assist to provide a level of control over assisted lift of the production fluids to surface.

The variable orifice gas lift valve may be controllable to define a fully closed position (which may provide zero flow rate), a fully open position (which may provide a maximum flow rate), and/or one or more partially or intermediate open positions. In such an arrangement the method may comprise controlling the valve to adopt a desired position which provides a degree of optimised injection of lift gas in accordance with determined production pressure.

The method may comprise determining production pressure over a period of time. The period of time may be sufficient for a stable production pressure to be achieved, for example following a variation in injection flow rate of lift gas.

The method may comprise determining production pressure by measuring said production pressure, for example at or in the region of the point of injection into the production string. Such measurement may be achieved by one or more pressure sensors, such as a force collector type sensor, fibre optic pressure sensor or the like. The variable orifice gas lift valve may comprise one or more pressure sensors for use in determining production pressure.

The method may comprise autonomously controlling the variable orifice gas lift valve in accordance with the determined production pressure. Such autonomous control may be permitted without operator intervention or analysis.

The variable orifice gas lift valve may comprise or be provided in combination with a controller, wherein the method may comprise controlling, for example autonomously controlling, the variable orifice gas lift valve using the controller. The controller may operate under the instruction of one or more control algorithms or process instructions associated with the controller (for example stored in memory). In some embodiments the controller may receive or determine data associated with the production pressure, and subsequently control the gas lift valve in accordance with said pressure data.

The controller may be loaded with a desired algorithm, for example selected based on expected or determined well parameters. In some embodiments the controller may include multiple different algorithms, and be configured to switch between said different algorithms. Such switching may be achieved autonomously by the variable orifice gas lift valve, for example in response to sensed parameters, such as sensed production pressure parameters or the like. Alternatively, or additionally, such switching may be achieved in response to an operator signal, for example a wired signal, pressure pulse signal or the like.

Control, for example autonomous control, of the variable orifice gas lift valve may be provided to modify or control the injection flow rate of lift gas to permit a desired or target production pressure or condition to be achieved. This may serve to allow optimisation of the gas lift process. The method may thus comprise or relate to a method for optimising injection of a lift gas into a production string by controlling, for example autonomously controlling, a variable orifice gas lift valve in accordance with production pressure within said production string. Such optimisation may provide advantages in terms of, for example, assisting to optimise production rates, optimising the use of lift gas reserves and the like.

Controlling the variable orifice gas lift valve in accordance with production pressure, for example to achieve a desired or target production pressure or condition, may assist to minimise or de-sensitise the valve from the effect of wear, erosion, deformation or the like of said valve. That is, wear, erosion etc. within a variable orifice gas lift valve may result in enlargement of the orifice flow path over time. However, by providing control relative to production pressure, any wear, erosion etc. will be autonomously accounted for by suitable adjustments in the variable orifice valve.

Some embodiments may assist to ensure that the gas lift operation is optimised in terms of ensuring or establishing an appropriate or required (e.g., optimised) flow rate of lift gas to achieve a desired or target (e.g., optimised) flowing production pressure. In some embodiments the desired or target (e.g., optimised) flowing production pressure may be a pressure which permits a desired, for example maximum, production flow rate to be achieved. Thus, some aspects or embodiments may relate to a method for optimising production.

A desired or target production pressure may be stored within memory, for example within a controller, associated with the variable orifice gas lift valve. The memory may be interrogated, for example by a controller, following determination of production pressure.

The desired or target production pressure may comprise a pressure value. In such an embodiment the method may comprise controlling the variable orifice gas lift valve until the pressure value is achieved or closely achieved.

The desired or target production pressure may comprise a pressure condition. In such an embodiment the method may comprise controlling the variable orifice gas lift valve until the pressure condition is achieved or closely achieved.

In some embodiments the pressure condition may comprise a substantially minimum production pressure. In some instances such a minimum production pressure may assist to maximise production recovery rates, thus optimising the effect of lift gas injection.

In some embodiments the substantially minimum production pressure may comprise the lowest production pressure achieved or achievable with injection of lift gas via the variable orifice gas lift valve. In other embodiments the substantially minimum production pressure may not necessarily comprise the lowest possible production pressure, but rather a production pressure which is still minimised yet is above the lowest possible production pressure. This may be the case where disproportionate increases in lift gas become necessary for limited or marginal reduction in production pressure. In this way optimisation may take into account diminishing returns such that an optimum valve setting may be achieved not just in accordance with production pressure, but also taking into account the volume of injection gas used, energy requirements to compress the gas and the like. In such embodiments where optimisation seeks to minimise production pressure, but not necessarily to achieve the absolute minimum, the desired or target minimised production pressure may be established at the discretion of a user.

In alternative embodiments the pressure condition may comprise a maximum production pressure achieved or achievable with injection of lift gas via the variable orifice lift valve. Alternatively, the pressure condition may comprise a pressure which is intermediate maximum and minimum production pressures achieved or achievable with injection of lift gas via the variable orifice lift valve.

The method may comprise determining a required, for example optimised, setting of the variable orifice gas lift valve to provide a desired production pressure or condition, and then controlling the valve to achieve this setting. The step of determining a setting of the variable orifice gas lift valve may be achieved autonomously.

In some embodiments the method may comprise operating the variable orifice gas lift valve in a learning mode of operation. Such a learning mode of operation may permit a setting of the variable orifice gas lift valve to be determined which provides a desired production pressure or condition.

Once the required setting of the gas lift valve is determined, the valve may subsequently be operated in an operational mode of operation. In such an operational mode of operation the variable orifice gas lift valve may remain at a set position previously determined during a learning mode of operation.

In some embodiments the method may comprise switching from an operational mode of operation to, for example back to, a learning mode of operation. This may assist to ensure a desired or optimised valve setting is maintained. Such switching between learning and operational modes of operation may define an optimisation cycle.

The method of determining a setting of the gas lift valve (for example in a learning mode of operation) may comprise determining the production pressure with the gas lift valve set at multiple positions, and then selecting the setting of the valve which provides or closely provides a desired or target production pressure or condition.

In some embodiments the method may comprise setting the gas lift valve at different incremental positions between a fully closed state and a fully open state, and determining the valve position which provides a substantially minimum (e.g., lowest or minimised) production pressure. Once the valve position which provides the substantially minimum production pressure is determined, the valve may be set to this position. Once set, the valve may be operated in an operational mode of operation.

The method of determining a setting of the gas lift valve (for example in a learning mode of operation) may comprise:

determining production pressure with the gas lift valve set to a first position;

determining production pressure with the gas lift valve set to at least one further position; and using the determined production pressures to control the gas lift valve to be set to an operational position which provides a desired or target production pressure or condition.

The operational position may comprise the first position or at least one further position. In some embodiments the operational position may comprise an intermediate position, for example between the first position and a further position, or between two further positions at which production pressure was determined.

The method may comprise altering the variable orifice gas lift valve to be set to multiple further positions, and determining production pressure with the gas lift valve set to some or all of the multiple further positions.

The method may comprise retaining the gas lift valve at a position when a required production pressure, for example pressure value, is determined. For example, when a desired or target production pressure is achieved or determined, no further variation of the gas lift valve may be made, and the valve may be switched from a learning mode of operation to an operational mode of operation.

The method of determining a setting of the gas lift valve (for example in a learning mode of operation) may comprise:

setting the variable orifice gas lift valve to a first position which provides a first injection flow rate of lift gas, and determining a first production pressure;

setting the variable orifice gas lift valve to a second position which provides a second injection flow rate of lift gas which is different from the first injection flow rate, and determining a second production pressure; and controlling the variable orifice gas lift valve in accordance with the first and second determined production pressures, for example in accordance with a variation between the first and second determined production pressures.

The method may comprise controlling the variable orifice gas lift valve, in accordance with the first and second determined production pressures, to be set to an operational position. For example, the valve may be controlled to be set to one of the first and second positions. In one embodiment the valve may be controlled to be set to one of the first and second positions which provides a substantially minimum (e.g., lowest or minimised) production pressure.

The method may alternatively comprise controlling the variable orifice gas lift valve, in accordance with the first and second determined production pressures, to be set to a third position which provides a third injection flow rate of lift gas which is different from the first and second injection flow rates, and determining a third production pressure. The method may then comprise controlling the variable orifice gas lift valve in accordance with one, some or all of the first, second and third determined production pressures.

The third position may be determined in accordance with an increase or decrease in pressure between the first and second determined production pressures. Such an arrangement may permit optimisation of the learning mode of operation, for example to minimise a learning time which may provide benefits in terms of battery life and the like.

In some embodiments the third position may be determined in accordance with a desire to achieve a minimum production pressure.

In one embodiment, where the second injection flow rate is larger than the first injection flow rate and the second production pressure is determined to be lower than the first production pressure, the third position may be selected to provide a third injection flow rate which is larger than the second injection flow rate.

In one embodiment, where the second injection flow rate is larger than the first injection flow rate and the second production pressure is determined to be higher than the first production pressure, the third position may be selected to provide a third injection flow rate which is lower than the first injection flow rate.

In one embodiment, where the second injection flow rate is lower than the first injection flow rate and the second production pressure is determined to be lower than the first production pressure, the third position may be selected to provide a third injection flow rate which is lower than the first injection flow rate.

In one embodiment, where the second injection flow rate is lower than the first injection flow rate and the second production pressure is determined to be higher than the first production pressure, the third position may be selected to provide a third injection flow rate which is larger than the second injection flow rate.

In one embodiment, the variable orifice gas lift valve may be controlled to be set to one of the first, second and third settings which provides a substantially minimum (e.g., lowest or minimised) production pressure.

In some embodiments the method may comprise determining the variation in production pressure recorded with different valve positions, for example sequential positions, and controlling the valve in accordance with the variation in production pressure.

In some embodiments the method may comprise:

setting the valve at a first position and recording a first production pressure;

setting the valve at a second position and recording a second production pressure;

determining a first pressure variation between the first and second production pressures; and controlling the valve in accordance with the first pressure variation.

The method may comprise controlling the valve to at least one of return to the first position or remain at the second position when the first pressure variation falls below a threshold value, which may be defined as a first derivative threshold value.

If the first pressure variation is above the first derivative threshold value the method may comprise:

controlling the valve to be set to a third position and recording a third production pressure;

determining a second pressure variation between the second and third production pressures; and controlling the valve in accordance with the second pressure variation.

The method may proceed accordingly, until such time as the first derivative threshold is reached.

The method may comprise controlling the variable orifice gas lift valve to close to prevent flow of lift gas when it is determined that the production pressure is lower than a lower threshold level. Such an arrangement may prevent gas injection when production may not require assistance. Further, such an arrangement may assist to facilitate control of an injection point of lift gas into a production string which is associated with multiple variable orifice gas lift valves. For example, a deeper set gas lift valve may define a higher "lower" threshold limit than a shallower set gas lift valve, such that the deeper set gas lift valve may be open (due to higher hydrostatic pressure within the production string), while the shallower set valve may close. In this way the injection point may move progressively lower along the production string.

When it is determined that the production pressure is above the lower threshold level, the method may comprise controlling the gas lift valve to define a desired injection flow rate of lift gas in accordance with production pressure. In such an arrangement the method may comprise controlling the variable orifice gas lift valve in a learning mode of operation when production pressure is determined to be above the production pressure lower threshold level. Accordingly, the production pressure lower threshold level may be considered a lower learning limit.

The method may comprise controlling the variable orifice gas lift valve to at least one of fully closed or fully open when it is determined that the production pressure is higher than an upper threshold level. When it is determined that the production pressure is lower than the production pressure upper threshold level, the method may comprise controlling the gas lift valve to define a desired injection flow rate of lift gas in accordance with production pressure. In such an arrangement the method may comprise controlling the variable orifice gas lift valve in a learning mode of operation when the production pressure is determined to be lower than the upper threshold level. Accordingly, the production pressure upper threshold level may be considered an upper learning limit.

Providing control of the valve in a learning mode of operation only between lower and upper production pressure threshold limits may assist to preserve energy, such as battery power.

In some embodiments the method may comprise operating the variable orifice gas lift valve over a production pressure window, defined between lower and upper production pressure threshold limits. Such an arrangement may provide advantages in minimising power requirements from an energy source, such as a battery. Further, such an arrangement may provide advantages in operations where multiple variable orifice gas lift valves are provided along the production string at different locations. For example, the method may comprise controlling a first gas lift valve to operate within a first pressure window, and controlling a second, deeper set gas lift valve to operate within a second pressure window. In some embodiments the first and second pressure windows may overlap each other such that for some production pressures only one valve may be open, and for other production pressures both valves may be open. Such an arrangement may permit continuous gas injection, for example to ensure that one of the first and second gas lift valves (for example a deeper set valve) is opened before the other of the first and second gas lift valves (for example a shallower set valve) is closed. This may assist to permit the injection point to move progressively, for example progressively lower along the production string. Such an arrangement may provide an advantageous method of injection a lift gas into deeper regions of a wellbore.

The method may comprise controlling the variable orifice gas lift valve to be fully closed when said valve is being deployed into a wellbore, for example deployed while mounted on the production string. Such an arrangement may facilitate pressure operations, such as pressure setting of packers, pressure testing operations and the like. For example, a tubing string containing the gas lift valve may be subject to a pressure test, and/or other components associated with the tubing string may be pressure operated, tested or the like. Alternatively, or additionally, pressure operations, such as pressure testing, may be achieved in a wellbore annulus region.

In some embodiments, the gas lift valve may be closable after a period of being opened to permit repeated or alternative pressure operations, such as pressure testing, to be performed.

The method may comprise initially fully opening the variable orifice gas lift valve, for example once fully deployed and installed, following required pressure testing or the like. The valve may be initially fully opened to facilitate unloading of the well, for example to displace resident fluids within an annulus surrounding the production string into said production string and to surface, initially reducing the production pressure within the production string, and/or the like.

The method may comprise initially fully opening the valve from a fully closed position in accordance with a predetermined lapsed time. Alternatively, or additionally, the method may comprise initially fully opening the valve from a fully closed position in accordance with a control signal sent from surface, such as via a pressure pulse signal, for example imparted into the production fluid via a surface choke, or the like. In such an arrangement the variable orifice injection valve may comprise a receiver for receiving control signals, such as a pressure signal receiver. The receiver may comprise a pressure sensor, such as the same pressure sensor which is used to determine production pressure within the production tubing string. In other embodiments a pressure signal may be imparted into the lift gas. In other embodiments a control signal may be provided via an alternative communication medium, such as via an electrical conductor, optical fibre, tubular body and/or the like. Alternatively, or additionally, a wave based signal, for example an EM based signal may be transmitted via the surrounding infrastructure/geology, such as a very low frequency signal.

The method may comprise controlling the valve following the initially fully open stage in a learning mode of operation. The method may comprise switching to the learning mode of operation following a predetermined lapsed time, in accordance with a received control signal or the like.

The method may comprise controlling the variable orifice gas lift valve to adopt a sleep mode of operation for a period of time. Such an arrangement may assist to minimise power usage and maximise battery life, if present. The method may comprise alternating between a learning mode of operation and a sleep mode of operation.

The method may comprise recording data associated with the variable orifice gas lift valve. The recorded data may be sent to surface, for example via wired or wireless communication. Alternatively, the recorded data may be retrieved from the valve (for example from memory associated with the valve) when said valve is retrieved to surface.

In some embodiments an operator may retrieve the variable orifice gas lift valve and replace this with a replacement gas lift valve. In some embodiments the replacement valve may comprise a variable orifice gas lift valve. The replacement variable orifice gas lift valve may be optimised in accordance with the data from the retrieved valve. For example, the data from the retrieved gas lift valve may permit a smaller and/or more focussed operating window of the replacement valve to be established, thus providing advantages in terms of, for example, energy usage, battery life and the like.

In some embodiments the replacement gas lift valve may comprise a fixed orifice gas lift valve. In such an arrangement the fixed orifice may be set in accordance with data from the retrieved gas lift valve. In some examples such a fixed orifice gas lift valve may be a temporary installation, until a variable orifice gas lift valve can again be installed. In alternative embodiments such a fixed orifice gas lift valve may be a permanent installation.

In some embodiments the ability to utilise a variable orifice gas lift valve to determine and deploy an optimum fixed orifice gas lift valve may provide a well design method. That is, the variable orifice gas lift valve may determine an optimised orifice size, which is subsequently provided by the replacement fixed orifice valve.

The method may comprise installing a variable orifice gas lift valve along a production string. The variable orifice gas lift valve may be installed together with the production string. As such, the variable orifice gas lift valve may be installed as part of an original completion.

In some embodiments the variable orifice gas lift valve may be installed subsequently to installing a production string within a wellbore, for example to permit the valve to be retrofitted.

In some embodiments the gas lift valve may be deployed and/or retrieved via wireline, for example using a wireline kick-over tool, such as may be used to deploy and retrieve a tool from a side-pocket mandrel.

In some embodiments the method may comprise sensing, and optionally recording, data associated with temperature, annulus pressure and the like. Such data may be used during control of the variable orifice gas lift valve.

The method may comprise determining, for example by sensing, pressure in a region externally of the production string. The method may comprise determining pressure in an annulus region externally of the production string.

The region externally of the production string may define a flow path for lift gas provided or delivered from a source of lift gas, such as from surface. In such an arrangement the method may comprise determining injection pressure. The region externally of the production string may be considered upstream of the variable orifice gas lift valve.

The variable orifice gas lift valve may comprise a pressure sensor for determining pressure in a region externally of the production string. Such an arrangement may conveniently provide a determination of pressure to be made in close proximity to the variable orifice gas lift valve. Alternatively, or additionally, a separate sensor may be utilised for determining pressure in a region externally of the production string.

The method may comprise receiving a signal by determining pressure in the region externally of the production string. The signal may be used to provide control instructions to the variable orifice gas lift valve. In some embodiments, pressure within the region externally of the production string may be varied to embed a signal to be detected at or in the region of the variable orifice gas lift valve. In some embodiments it may be convenient or suit operations for a user to intentionally modify or vary pressure in the region externally of the production string, as opposed to, for example, to modify production pressure within the production string. However, it should be understood that signalling by modifying or varying pressure within the production string may be desirable in some embodiments.

In some embodiments the signal may be used to control the valve, modify or run a control algorithm, or the like.

The method may comprise determining, for example by sensing, pressure both internally of the production string and in a region externally of the production string. The determined internal and external pressures may be used, for example, for autonomous valve control, optimisation, condition monitoring, signalling, as a control input or the like. The determined internal and external pressures may be utilised individually. The determined internal and external pressures may be utilised together. For example, a pressure differential between internal and external pressures may be determined and used. The pressure differential may be determined directly, for example by a differential pressure sensor. Alternatively, or additionally, individual determinations may be made of the internal and external pressures for use in determining the pressure differential.

In some embodiments the determined internal and external pressures may provide additional data for use in autonomous valve control, condition monitoring or the like. For example, a target pressure differential may be sought during an optimisation cycle, for example during operation in a learning mode of operation.

In some embodiments a pressure differential between internal and external pressures may be determined and compared against an expected or target differential. For example, a deviation of the determined pressure differential beyond an expected or target differential may indicate a requirement to perform a diagnostic test, perform an optimisation cycle, for example in a learning mode of operation, or the like. A deviation from an expected or target differential may initiate a control operation, for example to control the valve in a particular manner or by using a particular control algorithm or the like.

The method may comprise determining the pressure differential continuously, at time intervals, following a valve operation, such as opening, closing, change of position, or the like.

The method may comprise determining the pressure differential at two different times, and utilising any change in the determined pressure differential for control or operational purposes.

In some embodiments it may be desirable to keep a minimum differential between the internal and external pressures which could be monitored by one or more sensors.

In some embodiments the determination of internal and external pressures may provide an input for use in a flow algorithm. The determination of internal and external pressures may permit an orifice size within the variable orifice gas lift valve to be determined or approximated.

The method may comprise recording data associated with internal and/or internal pressures, pressure differentials or the like. Such recorded data may be returned to surface, for example via data transmission, following retrieval of the valve or the like. The data may be compared or examined with surface data. In some embodiments the recorded data may be time stamped to permit comparison with equivalent time stamped surface data. Comparison of recorded data with surface data may be used to check the accuracy of equipment and pressure calculations. Such an arrangement may facilitate use of the valve as a diagnostic tool, for example, to make decisions concerning requirement for expensive remedial work.

In some embodiments the method may comprise sensing temperature, for example at or in the region of the point of injection of the lift gas. The method may comprise performing calibration of equipment using the sensed temperature. For example, the method may comprise using sensed temperature to calibrate a pressure sensor associated with the variable orifice gas lift valve.

The method may comprise:

determining temperature, for example at or in the region of the point of injection of the lift gas; and controlling the variable orifice gas lift valve in accordance with the determined temperature.

In some embodiments the method may comprise determining a temperature profile associated with varying injection rates of gas, and controlling the valve in accordance with the determined temperature profile.

The method may comprise determining flow rate of fluid within the production string. The method may comprise controlling the variable orifice gas lift valve in accordance with the determined flow rate. The flow rate may be determined using pressure data, temperature data or the like. The flow rate may be determined using a flow meter.

In some embodiments the method may comprise transmitting one or more control signals to be received by the variable orifice gas lift valve. The control signals may function to adjust the mode of operation of the valve, for example. The control signals may be provided wirelessly, for example via pressure pulses, such as might be imparted into the production fluids from a surface controlled choke, imparted into the lift gas or the like. The control signals may be transmitted by wire or other suitable medium or guide.

The method may comprise providing or establishing a hard-wire connection between the variable orifice gas lift valve and a remote location, for example a surface location. The hard-wire connection may include a data connection, power connection and/or the like. The hard-wire connection may facilitate communication to/from the valve, provision of control signals, provision of software and/or algorithm updates, the provision of power to the valve, for example for direct use, to re-charge batteries and/or the like.

The hard-wire connection may comprise an electrical conductor, fibre optic wire and/or the like. The hard-wire connection may comprise a permanent connection, for example provided prior to deployment of the gas lift valve. The hard-wire connection may comprise a releasable connection, for example permitting subsequent disconnection, and optionally reconnection.

The hard-wire connection may be provided subsequent to deployment of the variable orifice gas lift valve. The variable orifice gas lift valve may comprise a connector arrangement to facilitate creation of the hard-wire connection. The connector arrangement may comprise a mechanical connector, electrical connector, optical connector and/or the like. The connector arrangement may comprise a mating wet connector.

The method may comprise testing the variable orifice gas lift valve prior to deployment. Such testing may seek to confirm that the valve has been suitably programmed, for example with the desired operational algorithms and the like. Such programming may be achieved prior to shipping of the valve to the deployment site. The method may comprise connecting the valve with a testing apparatus for use in interrogating the valve to confirm correct set-up.

The lift gas may comprise any suitable lift gas known in the art, and may comprise, for example, hydrocarbon gas or the like. In some embodiments the lift gas may be obtained from fluids produced via the production string.

The variable orifice gas lift valve may be secured to the production string. In some embodiments the variable orifice gas lift valve may be mounted within a pocket of a side-pocket mandrel coupled to or forming part of the production string.

The variable orifice gas lift valve may comprise a valve housing. The valve housing may define outer dimensions to permit installation with a side-pocket of a side-pocket mandrel. The valve housing may carry one or more seals to facilitate sealed installation within the production string.

The variable orifice gas lift valve may comprise a fluid inlet for receiving lift gas from a source. The fluid inlet may be defined in or by the valve housing. The source may be located at a downhole position. Alternatively, or additionally, the source may be located at a surface position.

In some embodiments the source may comprise a gas-bearing subterranean formation. For example, the variable orifice gas lift valve may be arranged in communication with a gas stream from a subterranean formation. In this case the method (and gas lift valve) may accommodate forms of gas lift known as auto lift, natural lift or in-situ lift.

In some embodiments the fluid inlet may be arranged in communication with a lift gas flow path, wherein the lift gas flow path is in communication with a source of lift gas. In some embodiments the lift gas flow path may supply lift gas to a single gas lift valve, or alternatively to multiple gas lift valves associated with the production string. The lift gas flow path may comprise a fluid conduit, such as a pipe structure. The lift gas flow path may comprise or be at least partially defined by an annulus at least partially surrounding the production string. In such an embodiment the variable orifice gas lift valve may function to control flow of lift gas from the annulus into the production string.

In some embodiments the fluid inlet of the variable orifice gas lift valve may be aligned with a port, for example an inlet port, of a side-pocket gas lift mandrel.

The fluid inlet of the variable orifice gas lift valve may comprise a single port. Alternatively, the fluid inlet may comprise multiple ports.

The variable orifice gas lift valve may comprise a fluid outlet for communicating lift gas into the production string to be mixed with produced fluid within the production string. The fluid outlet may be defined in or by the valve housing.

As noted above, the variable orifice gas lift valve may comprise a controller. The controller may be provided by a PCB. The controller may be mounted within the valve housing. Alternatively, the controller may be located remotely from the valve housing, for example remotely from the valve.

The variable orifice gas lift valve may comprise memory configured to store data, such as sensed data, algorithms, process instructions or the like. The memory may be in communication with the controller. The memory may be mounted within the valve housing. Alternatively, the memory may be located remotely from the valve housing, for example remotely from the valve.

The variable orifice gas lift valve may comprise a variable orifice between the valve inlet and outlet, wherein the variable orifice functions to vary the flow area, and thus lift gas flow rate, between the inlet and outlet. Control of the gas lift valve may thus comprise controlling or varying the variable orifice between the inlet and the outlet to thus vary injection flow rate.

The variable orifice may be provided within the valve housing.

The variable orifice may comprise at least two relatively adjustable members, wherein relative adjustment of said at least two members facilitates adjustment of the size of the variable orifice. In one embodiment the variable orifice may comprise a fixed member, such as a seat, and an actuatable member, such as a valve body.

The variable orifice may comprise a needle valve arrangement.

The variable orifice may comprise a flow sleeve arrangement.

The variable orifice may comprise at least one port, and an occluding member which moves relative to the at least one port to variably occlude said at least one port. In some embodiments multiple ports may be present.

In some embodiments the variable orifice may define a single or multiple orifices. In some embodiments the variable orifice may define a desired profile for use in providing a degree of fluid control. For example, the variable orifice may define a venturi profile.

The variable orifice gas lift valve may comprise an actuator for controlling the variable orifice gas lift valve, for example for controlling the variable orifice. The actuator may be coupled to an actuatable member of the variable orifice. The actuator may be controlled or controllable by the controller. The actuator may be mounted within the valve housing.

In some embodiments the actuator may comprise a motor, which may include an optional gearbox. The actuator may comprise a stepper motor.

In some embodiments the actuator may comprise a hydraulic actuator, such as a fluid piston actuator.

The variable orifice gas lift valve may comprise a power source. The power source may be provided remotely. Alternatively, or additionally, the power source may be provided within the valve housing. The power source may comprise one or more batteries. The power source may be rechargeable. The power source may be rechargeable by direct electrical connection to a charging arrangement, for example via a wired connection. The power source may be rechargeable by contactless communication with a charging arrangement, for example an inductance based charging arrangement.

The method may comprise operating the variable orifice gas lift valve in a defined manner in the event of the charge within the power source falling below a threshold value. In some embodiments the valve may be operated in a fail-as-is mode of operation, such that the valve is retained in its last position in the event of failure or discharge of the power source. Alternatively, the valve may operate in a fail-close mode of operation, such that the valve may close in the event of failure or discharge of the power source. Alternatively further, the valve may be controlled to cycle through a defined sequence of positions in the event of failure or discharge of the power source. In some cases the behaviour of the valve according to a drain or failure of the power source may provide a signal to an operator that a battery replacement, or otherwise, is required.

The variable orifice gas lift valve may comprise one or more sensors. The variable orifice gas lift valve may comprise one or more pressure sensors. At least one pressure sensor may be arranged to sense production pressure within the production string. At least one pressure sensor may be arranged to measure pressure within a region externally of the production string, for example within an annulus region surrounding the production string.

The variable orifice gas lift valve may comprise a temperature sensor.

At least one sensor may be provided within the valve housing.

The variable orifice gas lift valve may comprise a check valve. The check valve may be arranged to facilitate flow through the valve in a single direction, specifically an inflow direction while preventing back flow.

The check valve may be mounted within the valve housing.

In some embodiments, all components of the variable orifice gas lift valve may be provided on a common valve housing.

The variable orifice gas lift valve may be provided in accordance with any other aspect.

An embodiment or aspect of the invention relates to a gas lift valve, comprising:

a valve inlet for communicating with a source of lift gas and a valve outlet for communicating with a production string;

a variable orifice positioned between the valve inlet and valve outlet; and a controller configured to receive data associated with production pressure and control the variable orifice in accordance with said production pressure to control injection flow rate of a lift gas therethrough.

The gas lift valve may function to provide a method according to any other aspect. Accordingly, features associated with any other aspect may be provided in combination with the present aspect.

An aspect or embodiment of the invention relates to a method for injection of a lift gas into a wellbore production string, comprising:

determining production pressure within the production string; and controlling first and second variable orifice gas lift valves in accordance with the determined production pressure, wherein the variable orifice gas lift valves control the injection flow rate of the lift gas into the production string at different locations.

The method may comprise controlling the first gas lift valve to operate within a first pressure window, and controlling the second gas lift valve to operate within a second pressure window. In some embodiments the first and second pressure windows may overlap each other such that for some production pressures only one valve may be open, and for other production pressures both valves may be open. Such an arrangement may permit continuous gas injection, for example to ensure that one of the first and second gas lift valves (for example a deeper set valve) is opened before the other of the first and second gas lift valves (for example a shallower set valve) is closed. This may assist to permit the injection point to move progressively, for example progressively lower along the production string. Such an arrangement may provide an advantageous method of injection a lift gas into deeper regions of a wellbore.

An aspect or embodiment relates to a gas lift system, comprising:

a production string; and a gas lift valve according to any other aspect mounted to the production string.

The gas lift system may comprise multiple gas lift valves mounted on the production string at different locations along the length of the production string. Accordingly, when the gas lift system is installed within a wellbore, the gas lift valves may be mounted at different depths.

In some embodiments at least one gas lift valve may utilise sensed parameters associated with itself. In some embodiments at least one gas lift valve may utilise sensed parameters associated with at least one other gas lift valve. In some embodiments multiple gas lift valves may communicate with each other.

An aspect or embodiment of the invention relates to a method for installing a gas lift valve according to any other aspect within a wellbore. The method may comprise deploying the gas lift valve in combination with the production string. The method may comprise deploying the gas lift valve into a previously installed production string, for example using wireline techniques. The method may comprise deploying the gas lift valve into a side-pocket mandrel.

The method may comprise retrieving the gas lift valve. The method may comprise retrieving stored data from a retrieved gas lift valve.

An aspect or embodiment relates to a method for injection of a lift gas into a wellbore production string, comprising:

operating a variable orifice gas lift valve in a learning mode of operation to determine a setting of the variable orifice gas lift valve which provides a desired production pressure or condition.

The method may comprise operating the variable orifice gas lift valve in an operational mode of operation once the required setting of the gas lift valve is determined. In such an operational mode of operation the variable orifice gas lift valve may remain at a set position previously determined during a learning mode of operation.

The method may comprise switching from an operational mode of operation to, for example back to, a learning mode of operation. This may assist to ensure a desired or optimised valve setting is maintained. Such switching between learning and operational modes of operation may define an optimisation cycle.

In much of the foregoing reference is made to methods and apparatus for use in gas lift applications. However, features of the present invention may equally be used in other applications, such as controlling any fluid which is injected or otherwise communicated into a target location.

An aspect or embodiment relates to a valve, comprising:

a housing defining an inlet, an outlet and a flow path therebetween;

a valve member linearly moveable within the housing between first and second positions to vary flow along the flow path, wherein the valve member is prevented from rotation relative to the housing during linear movement between the first and second positions;

a rotary drive; and a transmission arrangement interposed between the rotary drive and the valve member for converting rotation of the rotary drive to linear movement of the valve member.

The valve may be for use in any suitable flow system. The valve may be for use in operations associated with the exploration and production of subterranean resources, such as oil and/or gas from subterranean reservoirs. The valve may be or define a gas lift valve. The valve may be or define a variable orifice gas lift valve. The valve may be or define an autonomous variable orifice gas lift valve. The valve may be configured for use in a method according to any other aspect.

The valve member may be moved linearly, without rotation, to vary flow along the flow path. Preventing the valve member from rotating relative to the housing may provide one or more advantages. For example, any sealing arrangement required between the valve member and the housing may be primarily directed to accommodating relative linear movement, and not necessarily need to also accommodate relative rotational motion. Further, by permitting control over the position of the valve member to be based only on linear movement, rather than a combination of linear and rotational, improved accuracy of positioning of the valve member within the housing may be achieved.

The first position of the valve member may define a partially closed position. The first position may define a fully closed position, such that no flow along the flow path is permitted when the valve member is in its first position. Location of the valve member at the first position may provide minimum flow area and flow through the flow path.

The valve may be configured such that when the valve member is in its first (e.g., closed) position fluid may still be permitted to enter the housing. Such an arrangement may permit fluid pressure at the inlet to be determined, even when the valve member is in its first (e.g., closed) position, from internally of the housing.

The second position of the valve member may define a partially open position. The second position may define a fully open position. Locating the valve member at the second position may provide maximum flow area and flow through the flow path.

The valve member may be locatable at one or more positions intermediate the first and second positions. The ability to locate the valve member at one or more intermediate positions may provide improved variability in flow area and flow along the flow path. The position of the valve member may be variable between discrete positions intermediate the first and second positions. The position of the valve member may be infinitely variable between the first and second positions.

The valve member may be linearly moveable relative to the housing to variably occlude at least one of the inlet and outlet to permit variation of the flow path.

The valve member may be linearly moveable relative to the housing to variably occlude the flow path, for example the area of the flow path, to permit variation of flow along the flow path.

The inlet of the housing may be in communication with the flow path. The inlet may extend through a wall, for example a side wall of the housing to communicate with the flow path. The inlet may extend laterally through a side wall of the housing. The inlet may define a flow axis. The inlet flow axis may be perpendicular to a flow axis of the flow path. The inlet flow axis may be obliquely aligned with a flow axis of the flow path.

The outlet of the housing may be in communication with the flow path. The outlet may extend through a wall of the housing. The outlet may define a flow axis. The outlet flow axis may be parallel with a flow axis of the flow path.

The valve may comprise a sealing arrangement to facilitate sealing between the valve member and the housing. The sealing arrangement may provide continuous sealing between the valve member and the housing. That is, the valve member may provide sealing between the valve member and the housing while the valve member is positioned in its first and second positions, and positions therebetween.

The sealing arrangement may provide sealing between the valve member and the housing only when the valve member is in one or more defined positions. The sealing arrangement may provide sealing between the valve member and the housing when the valve member is in at least its first position. Such sealing may permit the flow path to be sealed closed such that flow along the flow path is not permitted. Further, such an arrangement may assist to avoid or minimise hydraulic locking of the valve member during movement to/from its first position. Also, such an arrangement may permit fluid entering the housing via the inlet to be exposed to internal regions of the housing for other purposes, such as for determining the pressure of the inlet fluid.

The housing may define a sealing surface, and the valve member may define a corresponding sealing surface, wherein sealing is provided between the respective sealing surfaces.

The sealing arrangement may comprise one or more sealing members, such as O-rings or the like, wherein one or more sealing members are mounted on one or both of the housing and valve member.

The housing may define a bore within which the valve member is mounted and linearly moveable. At least a portion of the bore may at least partially define the flow path.

The bore of the housing may define a flow section. The valve member may be selectively inserted and retracted from the flow section during linear movement between the first and second positions to vary flow along the flow path. The valve member may be inserted into the flow section of the bore to be moved towards its first position, and retracted from the flow section of the bore to be moved towards its second position. Alternatively, the valve member may be retracted from the flow section of the bore to be moved towards its first position, and inserted into the flow section of the bore to be moved towards its second position.

The flow section of the housing bore may be defined between the housing inlet and housing outlet. In one embodiment the valve member may move across the inlet during linear movement to vary flow along the flow path.

The bore of the housing may define a valve member cavity section. The valve member cavity section may be defined by an extension of the flow section of the bore. The cavity section may permit the valve member to be received therein during retraction of the valve member from the flow section of the bore. The cavity section may be configured to permit the valve member to be moved or received therein during movement of the valve member towards its second (e.g., open) position.

When the valve member is in its first (e.g., closed) position the fluid inlet may be in fluid communication with the cavity section of the housing bore.

The rotary drive may be located on the flow section side of the valve member. Alternatively, the rotary drive may be located on the cavity section side of the valve member.

The valve member may comprise a flow restrictor section. The flow restrictor section may be arranged to be extended into the flow section of the bore of the housing to vary the flow area of the flow path. The flow restrictor section may be configured to vary the flow area of the flow path as a function of linear movement of the valve member. Such an arrangement may provide for variation of flow along the flow path in response to linear movement of the valve member.

The flow restrictor section may comprise or be defined by a narrowing portion of the valve member, which narrowing portion narrows in an axial or lengthwise direction of the valve member. Such a narrowing portion may permit a variation in the flow area of the flow path during linear movement of the valve member. The narrowing portion may extend to an end of the valve member. The narrowing portion may be provided by a tapering section, conical section or the like.

The flow restrictor section may comprise a recessed region, such as a fluting, extending into an outer surface of the valve member. The depth of the recessed region relative to an outer surface of the valve member may increase in an axial or lengthwise direction of the valve member. Such an increasing depth may permit a variation in the flow area of the flow path during linear movement of the valve member. The width of the recessed region may increase in an axial or lengthwise direction of the valve member. The recessed region may extend to an end of the valve member.

The recessed region may be formed adjacent a non-recessed region of the valve member. The non-recessed region may engage or otherwise interact with the housing, for example for stability, guidance and/or the like. The non-recessed region may interact with the housing to prevent relative rotation between the valve member and the housing.

The flow restrictor section may comprise a plurality of recessed regions. The recessed regions may be circumferentially distributed around the valve member. The recessed regions may be separated by non-recessed regions.

The valve member may comprise a body section, wherein the flow restrictor section extends from the body section. The body section may be configured for sealing engagement with the housing.

The transmission arrangement may comprise a drive shaft. The drive shaft may extend between the rotary drive and the valve member. The drive shaft may be formed separately from both the rotary drive and the valve member. The drive shaft may be coupled to the rotary drive via a torque transmitting coupling, such as via a splined connection, non-round interface, keyed connection and/or the like. The drive shaft may be at least partially defined by, for example integrally formed with, the rotary drive. The drive shaft may be at least partially defined by, for example integrally formed with, the valve member.

The transmission arrangement may comprise a threaded arrangement. The threaded arrangement may comprise a male threaded portion and a corresponding female threaded portion, wherein rotation of one of the male threaded portion and female threaded portion provided by the rotary drive provides linear motion of the other of the male threaded portion and female threaded portion, and thus of the valve member. In such a threaded transmission arrangement any transmission of torque between the male and female threaded portions may be prevented from causing rotation of the valve member by virtue of the valve member being non-rotational relative to the housing.

The valve member may comprise or define one of a male threaded portion and a female threaded portion, and the transmission arrangement may comprise a drive shaft extending from the rotary drive, wherein the drive shaft comprises or defines the other of the male threaded portion and the female threaded portion.

In one embodiment the valve member may comprise a threaded bore, and the drive shaft may comprise an external threaded portion received and threadedly engaged within the threaded bore. Rotation of the drive shaft within the threaded bore may cause the valve member to be selectively extended and retracted (e.g., in a telescoping manner) relative to the drive shaft.

Alternatively, the drive shaft may comprise a threaded bore, and the valve member may comprise an external threaded portion received and threadedly engaged within the threaded bore of the drive shaft.

The drive shaft may be coaxially aligned with the valve member.

The drive shaft may be define a central rotation axis which is off-set, for example laterally off-set, from a central axis of the valve member. As will be discussed in more detail below, such an off-set may assist to prevent rotation of the valve member relative to the housing.

The valve may comprise an anti-rotation arrangement for preventing relative rotation between the valve member and the housing.

At least a portion of the anti-rotation arrangement may be provided by the housing. At least a portion of the anti-rotation arrangement may be provided by the valve member. At least a portion of the anti-rotation arrangement may be provided by the transmission arrangement.

The valve member may be prevented from rotation relative to the housing by inter-engagement between the valve member and the housing.

Providing an anti-rotation arrangement between the valve member and the housing may minimise or eliminate the requirement to confine non-rotation features to the transmission arrangement. Otherwise, the transmission arrangement may require additional axial length to include a first portion which provides the necessary rotary/linear motion conversion, and a second portion which prevents the valve member from also rotating in response to operation of the rotary drive. This may permit the length of the valve to be minimised, which may contribute towards ensuring the valve may meet any design constrains associated with its end-use environment.

The housing may comprise or define a non-round bore section, and the valve member may comprise or define a corresponding non-round valve member section arranged to move axially within the non-round bore section of the housing. Inter-engagement of the non-round sections of the housing and valve member may permit the valve member to move linearly within the housing while preventing relative rotation therebetween.

Inter-engagement of the non-round bore and valve member sections may permit the geometry of the housing and valve member to provide anti-rotation, which may provide a larger interface which resists torque transmission. This may provide advantages over known systems, such as key and key-way anti-rotation systems where the torque is resisted over a relative small region or area.

The non-round bore section and the non-round valve member section may be of any suitable non-round shape. In one embodiment the non-round bore section and the non-round valve member section may be generally oval. The non-round bore section and the non-round valve member section may be generally elliptical. The non-round bore section and the non-round valve member section may be polygonal.

At least a portion of the non-round bore section may define at least a portion of the flow path. For example, a flow section of a housing bore may comprise a non-round section.

In embodiments where the valve member comprises a body section and a flow restrictor section, such as defined above, regions of both the body section and flow restrictor section may be non-round.

At least a portion of the non-round bore section and at least a portion of the non-round valve member section may comprise or be defined by continuously curved surfaces. Such continuously curved surfaces may extend continuously around the entire perimeter of the bore section/valve member section. Such continuously curved surfaces may thus not include any recesses or protrusions, such as might be required in conventional key and key-way anti-rotation arrangements. Such an arrangement may provide a simplified anti-rotation structure.

A flow section of a housing bore may define a continuously curved surface. A body section of the valve member may define a continuously curved surface.

The respective continuously curved surfaces may assist to permit sealing to be achieved between said continuously curved surfaces, for example by avoiding the requirement for complex shaped sealing members and the like which might need to accommodate recesses and protrusions, such as present in key and key-way anti-rotation arrangements. Sealing may be achieved by a sealing arrangement, such as described above.

The ability to provide a region of the valve which may provide both an anti-rotation function and a sealing function may permit simplification in the valve structure to be provided, for example by avoiding the requirement to include separate regions providing the separate functions.

The transmission arrangement may comprise a drive shaft extending between the rotary drive and the valve member, wherein the drive shaft may define a central rotation axis which is off-set, for example laterally off-set, from a central axis of the valve member. Such an arrangement may function to prevent rotation of the valve member by the drive shaft.

The rotary drive may comprise a motor. The motor may comprise an electrical motor. The motor may comprise a stepper motor.

The rotary drive may be mounted within a chamber within the housing. The chamber may be filled with a chamber fluid, such as mineral oil. Such an arrangement may permit the rotary drive to be retained in a clean environment, for example isolated from the fluid passing through the valve flow path.

The rotary drive may be fixed within the housing.

The valve may comprise a pressure balance arrangement for permitting the chamber containing the rotary drive to be pressure balanced with a region externally of the chamber. Such an arrangement may permit the chamber pressure to track the pressure of the region externally of the chamber. The region externally of the chamber may comprise the housing bore within which the valve member moves. The pressure balance arrangement may be configured to pressure balance the chamber with fluid pressure at the inlet of the housing.

The pressure balance arrangement may comprise a pressure transfer member. The pressure transfer member may define a moveable wall boundary of the chamber. The pressure transfer member may be linearly moveable within the housing. One side of the pressure transfer member may be in pressure communication with the chamber fluid, and an opposing side of the pressure transfer member may be in pressure communication with a region externally of the chamber, for example with a housing bore which accommodates the valve member. The pressure transfer member may be arranged to move in accordance with a pressure differential on opposing sides thereof, and thus seek to establish an pressure equilibrium.

The pressure transfer member may be sealingly engaged with the housing. Such sealing engagement may be a dynamic sealing engagement, providing sealing while still permitting relative movement (e.g., linear movement) between the pressure transfer member and the housing.

The pressure transfer member may define an aperture therethrough, wherein the transmission arrangement (e.g., a drive shaft) may extend through the opening between the rotary drive and the valve member. The pressure transfer member may sealingly engage the transmission arrangement. Such sealing engagement may be a dynamic sealing engagement, providing sealing while still permitting relative movement (e.g., linear and rotational movement) between the pressure transfer member and the transmission arrangement (e.g., a drive shaft).

The pressure transfer member may thus provide a dual function. The first is to provide pressure balancing within the chamber, and the second is to provide the required seal with the transmission arrangement. This may permit the structure within the valve to be simplified, for example by eliminating the requirement for individual structures or arrangements to individually provide both pressure balance and sealing.

Furthermore, as the pressure transfer member provides both pressure balancing and sealing, the pressure differential across any seal will be minimised, improving the sealing capability/effectiveness.

The chamber may comprise a sensor for sensing pressure within the chamber. In embodiments where the chamber is pressure balanced with an external location or region then the sensor may effectively sense pressure at the external location, for example at inlet. However, such pressure determination may be possible without necessarily exposing the sensor to the fluid flowing through the valve, which may not be desirable. Such a pressure determination may be used in a control operation of the valve, such as defined in relation to any other aspect.

The valve may comprise a battery. The battery may be mounted within the housing.

The valve may comprise a sensor for sensing pressure associated with the outlet of the housing.

The valve may comprise a check valve for preventing reverse flow through the flow path (in a direction from the outlet to the inlet).

The valve may comprise at least on seal assembly for permitting the valve housing to be sealingly engaged within a pocket, such as a side pocket of a mandrel forming part of a wellbore string.

The valve may define a gas lift valve. The inlet may be in communication with a wellbore annulus region, and outlet may be in communication with production string.

The housing may be a single component or may comprise multiple components assembled together.

An aspect or embodiment relates to a valve, comprising:

- a housing defining an inlet and an outlet and a flow path therebetween, wherein the housing comprises a non-round bore section;
- a valve member moveable within the housing to vary flow along the flow path, wherein the valve member includes a non-round section arranged to move axially within the non-round bore section of the housing to prevent relative rotation between the valve member and the housing;
- a rotary drive; and
- a transmission arrangement interposed between the rotary drive and the valve member for converting rotary movement of the rotary drive arrangement to linear movement of the valve member.

In use, the inter-engagement of the non-round bore section and valve member portion may prevent relative rotation therebetween, such that the rotary motion of the rotary drive may provide the desired linear movement of the valve member without also causing rotation of said valve member.

An aspect or embodiment relates to a pressure balance assembly, comprising:

- a chamber;
- a pressure transfer member defining a moveable wall of the chamber and defining a first side in pressure communication with the chamber and an opposing second side in pressure communication with a region externally of the chamber, wherein the pressure transfer member comprises an aperture extending between the first and second sides thereof;
- a rotary member extending from the chamber and through the aperture of pressure transfer member; and
- a dynamic seal between the rotary member and the pressure transfer member.

The pressure transfer member may be arranged to move in accordance with a pressure differential acting across the first and second sides of the pressure transfer member. In this way, pressure acting on one side of the pressure transfer member may be imposed or manifested on the opposite side of the pressure transfer member.

The pressure transfer member may provide a dual function. The first is to provide pressure balancing within the chamber, and the second is to provide the required seal with the rotary member.

The dynamic seal may accommodate both relative rotary and linear movement.

The pressure balance assembly may comprise features associated with any other aspect.

It should be understood that the features defined in relation to one aspect or embodiment may be applied in combination with any other embodiment. For example, any features defined in relation to any method, may be equally applied to any defined apparatus, system or the like.

BRIEF DESCRIPTION OF THE DRAWINGS

These and other aspects of the present invention will now be described, by way of example only, with reference to the accompanying drawings, in which.

DETAILED DESCRIPTION OF THE DRAWINGS

Figure 1:
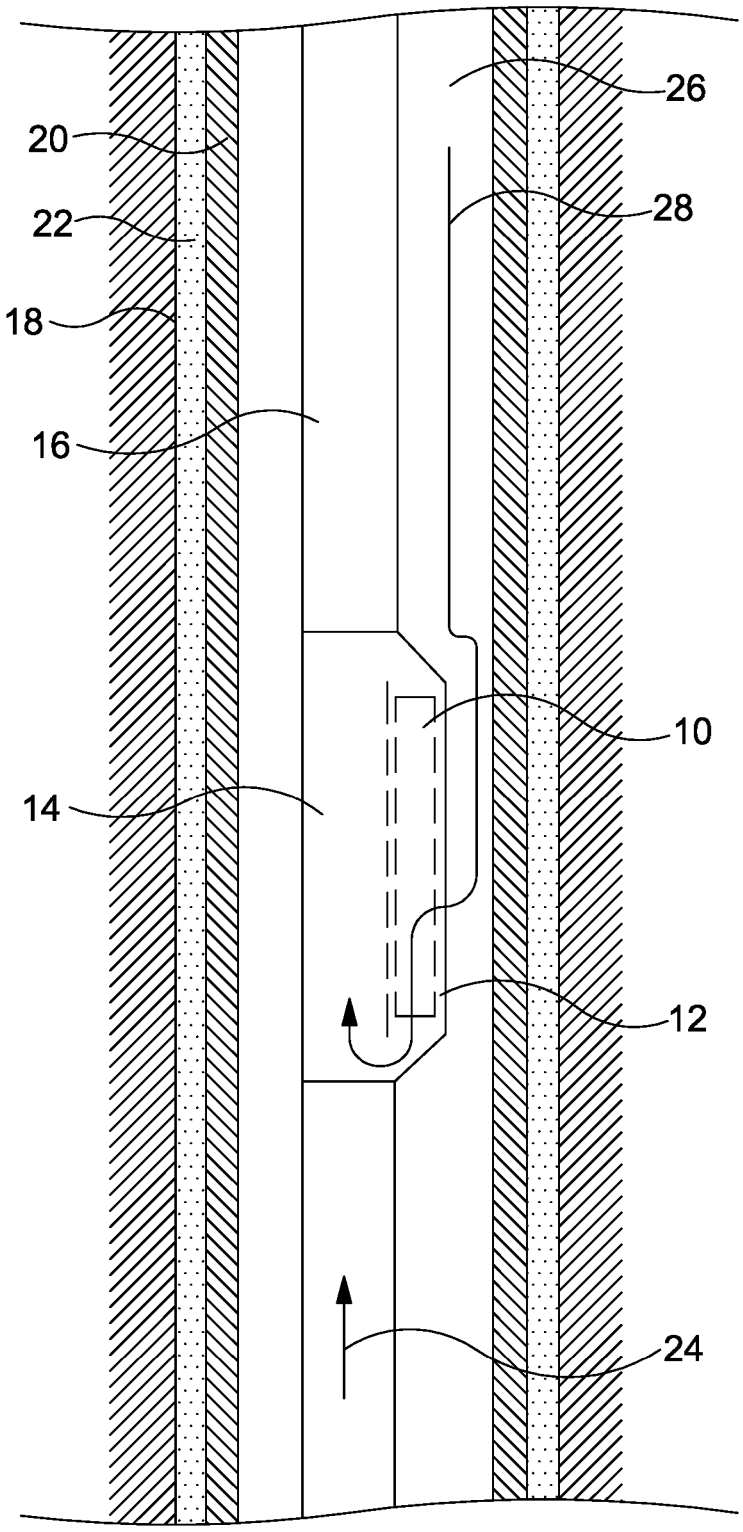
FIG. 1 is a diagrammatic illustration of a variable orifice gas lift valve installed in a production string in accordance with an embodiment of the present invention.

A variable orifice gas lift valve 10 according to an embodiment of the present invention is mounted within a side-pocket 12 of a side-pocket gas lift mandrel 14 which forms part of a production string 16. The production string 16 is mounted within a drilled wellbore 18 which is at least partially lined with a casing or liner string 20 with a cement sheath 22. The production string 16 provides a flow path for production of hydrocarbons from a production zone (not shown) to surface, with flow provided in the direction of arrow 24.

The variable orifice gas lift valve 10 functions to provide control of the injection of a lift gas, such as a hydrocarbon gas, from an annulus region 26 defined between the production string 16 and liner or casing 20, and into the production string 16, as illustrated by arrow 28. The lift gas may be provided from surface via suitable surface equipment, such as compressors and the like. Alternatively, the lift gas may originate from a gas-bearing formation (a process known as auto lift, natural lift or in-situ lift). As known in the art, the lift gas mixes with production fluids to effectively reduce the density of the fluid and thus the weight of the fluid column within the production string 16, enabling or assisting the available pressure to lift the fluid column to surface.

As will be described in more detail below, in some embodiments of the present invention the variable orifice gas lift valve 10 may be autonomously controlled in accordance with, at least, the production pressure within the production string 16 at the location of the valve 10. Such autonomous control may permit the valve to be self-optimising in accordance with production pressure.

Figure 2:
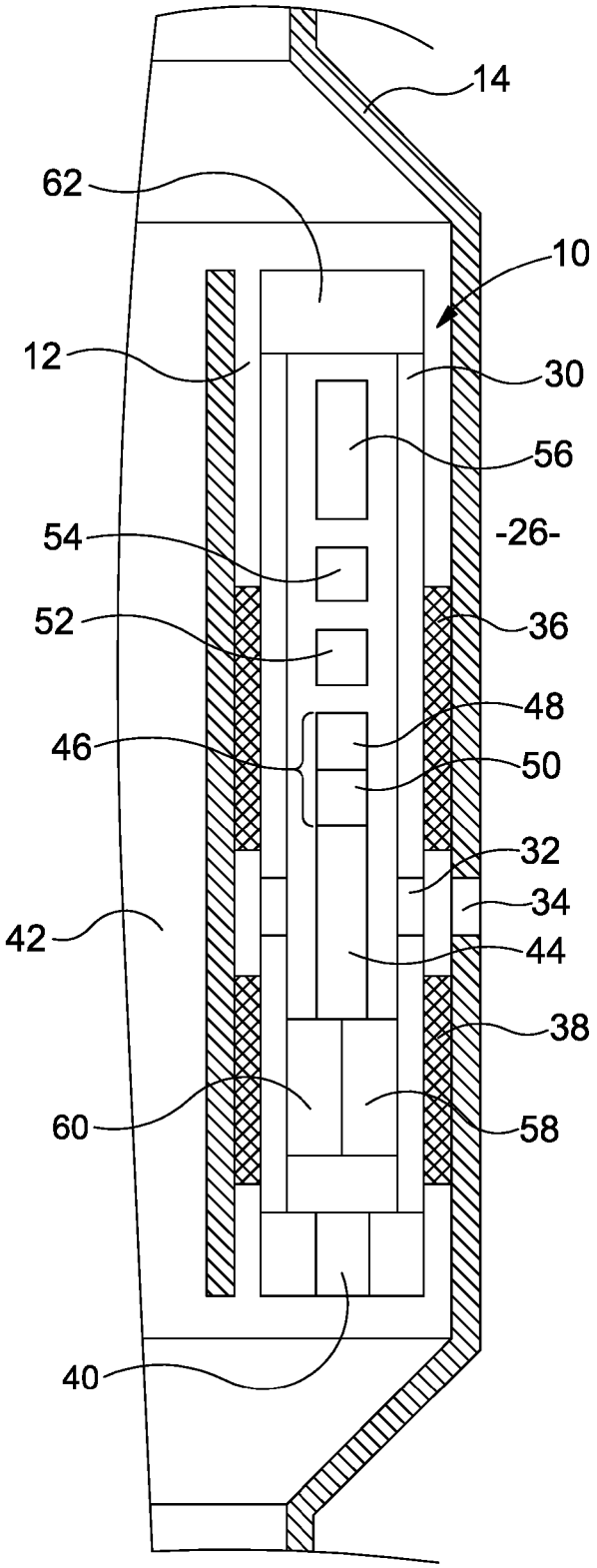
FIG. 2 is a further detailed diagrammatic illustration of the variable orifice gas lift valve of FIG. 1.

FIG. 2 provides an enlarged view of the variable orifice gas lift valve 10, located within the side-pocket 12 of mandrel 14, with the internal features of the valve 10 diagrammatically illustrated. The valve 10 includes a housing 30 which is suitably sized to be received within the side-pocket 12, and includes a fluid inlet 32 which is arranged in fluid communication with an outer port 34 formed in a side wall of the mandrel 14, such that lift gas within the annulus 26 may enter the valve 10 via the mandrel port 34 and valve fluid inlet 32. The valve housing 10 carries a pair of seals 36, 38 which straddle the valve fluid inlet 32 and mandrel port 34, and in use establish a seal between the housing 30 and the internal wall of the side-pocket 12, thus requiring all flow to be diverted through the valve 10.

The valve 10 further includes a fluid outlet 40 which is arranged in fluid communication with an internal passage 42 of the mandrel 14. A variable orifice assembly 44 is provided within the valve housing 30 between the fluid inlet 32 and outlet 40, and as will be described in more detail below is controllable to facilitate a variation in the orifice size, and thus lift gas flow rate into the internal passage 42 of the mandrel 14. Although the variable orifice assembly 44 is illustrated diagrammatically, various forms of assembly may be suitable, such as a spool mechanism, ported flow tube, valve member and seat, needle assembly, or the like. In the present embodiment the variable orifice valve assembly 44 is controllable between a completely closed position (zero lift gas flow rate), a fully open position (maximum lift gas flow rate), and one or more intermediate positions. Although not illustrated, the valve 10 may include a position sensor or arrangement to determine a position of the variable orifice assembly 44.

The valve 10 further includes an actuator assembly 46 provided within the valve housing 30 and coupled to the variable orifice valve assembly 44 to permit adjustment of said variable orifice valve assembly 44. In the present embodiment the actuator assembly 46 includes a motor 48 (such as a stepper motor) and associated gear box 50 (although the gear box may be optional). However, in other embodiments other actuator types may be used, such as hydraulic actuators or the like.

The valve 10 further includes a controller 52 provided within the valve housing 30. The controller 52, which may be provided in the form of a PCB, is coupled to the actuator assembly and is configured to operate in accordance with installed process instructions or algorithms, to effect suitable control, for example autonomous control, of the variable orifice assembly 44 via the actuator assembly 46. The controller 52 may also receive data associated with the position of the variable orifice assembly 44

The valve 10 further includes memory 54, which may contain suitable process instructions or algorithms to be used by the controller 52 to facilitate control of the variable orifice assembly 44. In some embodiments the memory 54 may be arranged to record data, such as pressure data, temperature date, orifice position data and the like, which may be obtained from associated sensors and the like.

The valve 10 further comprises a power source, which in the present embodiment is provided by a battery pack 56 also contained within the valve housing 30. The battery pack 56 may comprise one or more primary or secondary lithium batteries or the like. The battery pack 56 may comprise one or more rechargeable batteries.

The valve 10 further comprises a check valve 58, positioned between the variable orifice assembly 44 and the valve outlet 40, and functions to prevent any return flow from the internal passage 42 through the valve 10.

Further, the valve 10 includes a pressure sensor 60 which is positioned within the valve housing 30 and arranged to sense pressure within the internal passage 42 of the mandrel 14, which thus allows production pressure to be determined. The sensor 60 is in communication with the controller 52 such that the controller may utilise the pressure data to facilitate control of the variable orifice assembly 44.

Accordingly, all necessary equipment for functionality of the valve 10 may be provided within a common housing.

An upper end 62 of the housing 30 may comprise a connector assembly for permitting connection with a deployment/retrieval tool (not shown), such as a wireline kick-over tool.

As described above, the controller 52 is configured to permit control of the variable orifice assembly 44 in accordance with one or more defined process instructions or algorithms, to thus achieve appropriate control of the valve 10. Some example embodiments of process instructions or algorithms will now be described with reference to FIGS. 3 to 9. It should be noted that during the description of the example embodiments in FIGS. 3 to 9 reference is made to the valve 10 and associated components of FIGS. 1 and 2.

Figure 3:
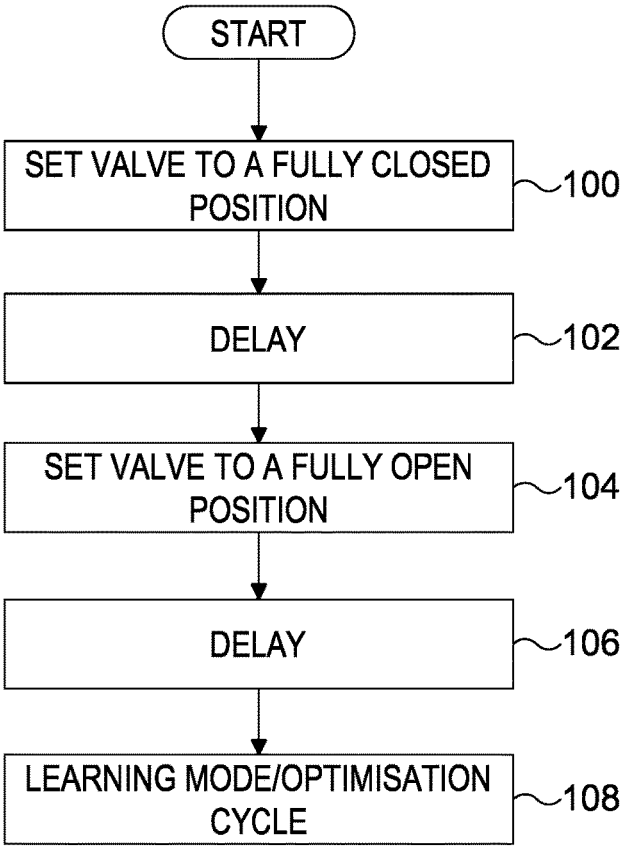
FIG. 3 diagrammatically illustrates an embodiment of a control process or method for controlling the variable orifice gas lift valve of FIG. 1.

FIG. 3 diagrammatically illustrates a process or method of controlling the valve 10 during initial use, in accordance with one embodiment of the present invention. In this case the valve 10 is initially set to a fully closed position 100, and held in this closed position for a period of delay 102. During this period of delay 102 the associated production string 16 may be pressurised, for example for testing purposes, for setting other tools such as packers or the like. The period of delay 102 may be determined by a suitable time period, such that following a set time period, as determined by the controller 52 (which may include a clock), the process may move forward to a subsequent step. Alternatively, the delay period 102 may be determined under operator control, and a suitable signal, for example from surface, may initiate progression to a subsequent step.

The valve 10 is then set to a fully open position 104, under control of the controller 52 and actuator assembly 46, thus providing a maximum permitted flow rate through the valve 10. The valve 10 is held in this fully open position for a period of delay 106. Holding the valve 10 fully open in this manner may facilitate initial well unloading, for example to displace fluids, such as completion fluids, initially contained within the annulus 26 into the production string 16 and to surface, and/or to initially lower the production pressure within the production string 16. The period of delay 106 may be determined by a suitable time period, such that following a set time period, as determined by the controller 52, the process may move forward to a subsequent step. Alternatively, the delay period 106 may be determined under operator control, and a suitable signal, for example from surface, may initiate progression to a subsequent step.

Control of the valve 10 then progresses to a subsequent step 108 in which the valve 10 functions in a learning mode of operation, during which mode of operation the variable orifice assembly 44 is autonomously controlled via the controller 52 and actuator assembly 46, and in accordance with production pressure within the production string 16 determined or measured by the pressure sensor 60. The purpose of such autonomous control is to allow the valve 10 to self-set to an optimised position which provides an optimum flow rate of lift gas to achieve an optimum production pressure.

Various examples of learning modes and optimisation cycles will be described below. However, in one general form the learning mode may involve:

1. Recording production pressure with the valve set at various positions;
2. Determining an optimum setting based on the recorded production pressures; and
3. Setting the valve to the optimum setting.

In the embodiments presented herein the valve 10 is controlled in accordance with, at least, production pressure. This may avoid potential issues where control may be based on a user setting a position of a variable orifice based on an expected outcome. For example, if the variable orifice has suffered erosion, a defined setting may not provide an orifice size expected. Embodiments of the present invention may therefore assist to minimise or de-sensitise the valve from the effect of erosion.

Figure 4:
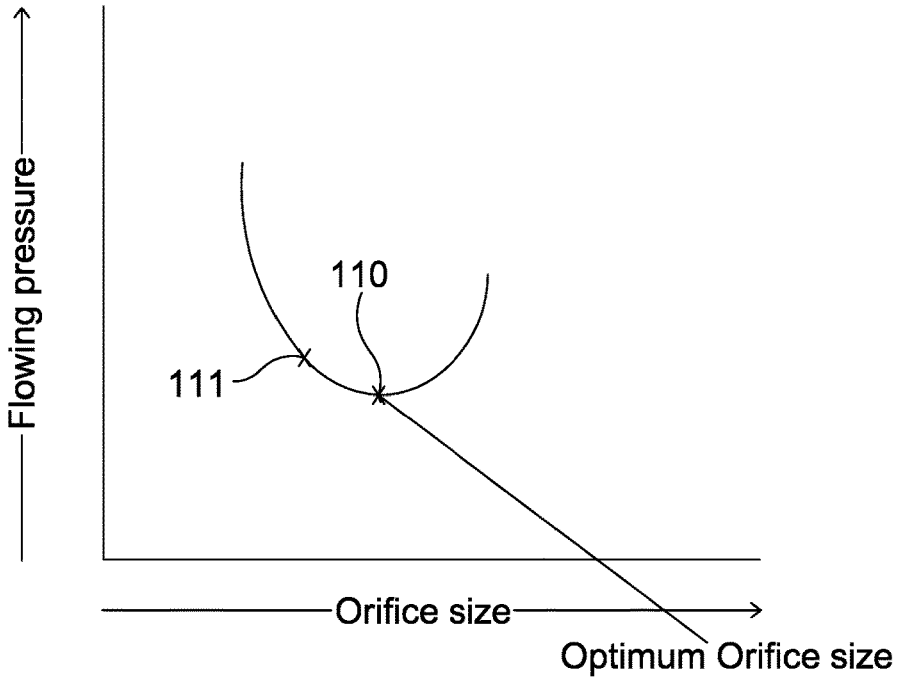
FIG. 4 diagrammatically illustrates an example optimisation criterion for controlling the variable orifice gas lift valve.

FIG. 4 provides a diagrammatic illustration of an output plot of production pressure vs orifice size within the variable orifice valve assembly 44. In one example embodiment, a learning mode of operation (step 108 in FIG. 3) is configured such that the valve 10 autonomously seeks an orifice size which permits a minimum production pressure to be achieved, which is indicated at point 110 in FIG. 4. In this example the minimum production pressure 110 is illustrated as the lowest production pressure achieved or achievable with injection of lift gas via valve 10.

However, in other embodiments the valve 10 may autonomously seek an optimum position in which the production pressure may not necessarily comprise the lowest possible production pressure (e.g., point 110), but rather a production pressure which is still minimised yet is above the lowest possible production pressure 110. For example, the valve 10 may autonomously seek a production pressure at point 111. This may be the case where disproportionate increases in lift gas become necessary for limited or marginal reduction in production pressure. In this way optimisation may take into account diminishing returns such that an optimum valve setting may be achieved not just in accordance with production pressure, but also taking into account the volume of injection gas used, energy requirements to compress the gas and the like. In some embodiments the controller may operate to identify point 111 by a recognition that the variation in production pressure with variation in orifice size (first derivative) falls below a threshold value.

It should therefore be understood that in the description herein, reference to minimum or lowest production pressure may not necessarily mean the absolute lowest production pressure achievable, but rather a production pressure which has been to some degree minimised through the autonomous operation of the valve 10.

Figure 5:
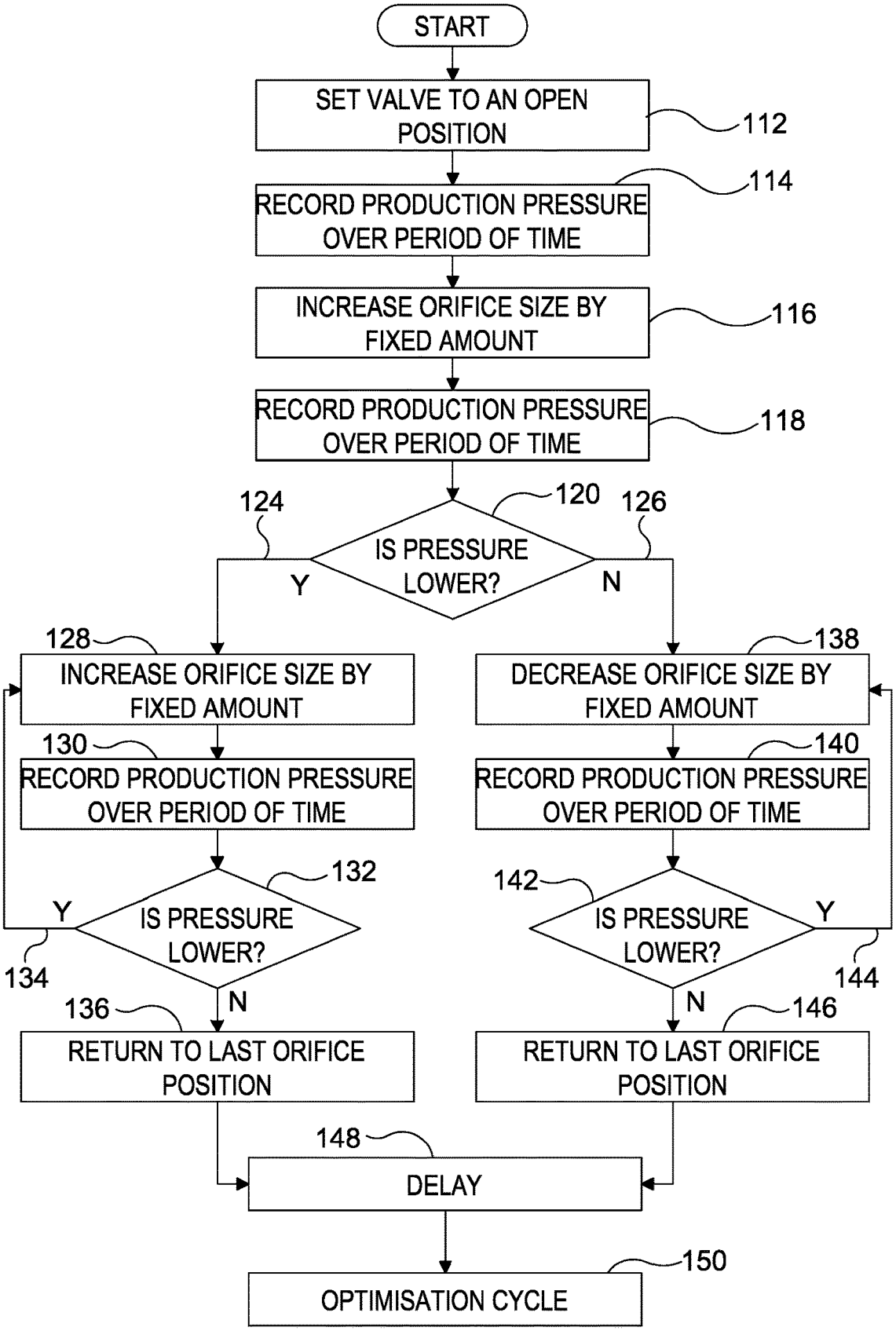
FIGS. 5 to 9 provide diagrammatic illustration of various control processes or methods for controlling the variable orifice gas lift valve of FIG. 1, in accordance with various embodiments of the present invention.

FIG. 5 diagrammatically illustrates a process or method for autonomously controlling the valve 10 in a learning mode of operation in accordance with one embodiment of the invention. The process starts with the valve 10 set to an initially open position 112. Such an open position may be arbitrarily selected, for example to a half open position. Alternatively, the initial open position may be determined in accordance with data associated with the wellbore, such as may have been obtained from prior well testing or the like. This may allow the valve 10 to be initially set to a position which may be close to optimised based on expected well performance. Production pressure, sensed via pressure sensor 60, is recorded over a period of time at step 114. The period of time may be sufficient to permit a stable production pressure to be achieved. In some embodiments the time period may be fixed. Alternatively, the period of time may be determined by the controller 52, for example when it is recognised that the pressure has stabilised or substantially stabilised.

The orifice size is then increased by a fixed amount at step 116, increasing injection gas flow rate, and production pressure is again recorded over a period of time at step 118. It is then determined at step 120 as to whether the production pressure recorded at step 118 is lower than the production pressure recorded at step 114. If the determination is affirmative, the process moves along process path 124. If the determination is negative the process moves along process path 126.

In process path 124 it may be considered that an increase in orifice size has provided a positive result in terms of reducing production pressure, and as such the orifice size may be further increased by a fixed amount at step 128, and production pressure recorded over a period of time at step 130, with subsequent step 132 making a determination as to whether the production pressure recorded at step 130 is lower than an immediately previously recorded production pressure, which for an initial process run will be the pressure recorded at step 118. If the determination is affirmative, the process moves along a looped process path 134, returning to step 128. In this case, each subsequent loop 134 seeks to determine at step 132 whether or not the recorded production pressure is lower than that recorded for each immediately previous orifice size, rather than continuously making the determination with respect to the recorded pressure at step 118.

When the determination at step 132 is negative the process moves to step 136 at which the orifice is returned to its previous position (or alternatively may be retained at the current position). At this stage the valve 10 may be considered to have reached an optimised position.

In process path 126 it may be considered that an increase in orifice size at step 116 has provided a negative result in terms of increasing production pressure (or having no effect on production pressure), and as such the orifice size may be decreased at step 138 by a fixed amount below the orifice setting at step 112. Production pressure may then be recorded over a period of time at step 140, with subsequent step 142 making a determination as to whether the production pressure recorded at step 140 is lower than an immediately previously recorded production pressure, which for an initial process will be the pressure recorded at step 114. If the determination is affirmative, the process moves along a looped process path 144, returning to step 138. In this case, each subsequent loop 144 seeks to determine at step 142 whether or not the recorded production pressure is lower than that recorded for each immediately previous orifice size, rather than continuously making the determination with respect to the initial recorded pressure at step 114.

When the determination at step 142 is negative the process moves to step 146 at which the orifice is returned to its previous position (or alternatively may be retained at the current position). At this stage the valve 10 may be considered to have reached an optimised position.

As noted above, the determination at steps 132, 142 is whether the previous change has made the pressure lower. However, in an alternative embodiment the determination may be whether the pressure variation (first derivative) achieved by the previous change is below a threshold value. If the determination is affirmative, an optimised position may be considered identified and the valve set accordingly. If the determination is negative, the process may loop along paths 134, 144.

The process may end at either step 136 or 146. In this case the valve 10 may be optimised once, and become permanently set to the determined optimised position. Alternatively, as illustrated in FIG. 5, following a delay step 148 the process may progress to an optimisation cycle 150, which may seek to maintain the valve 10 in an optimum position. For example, the optimisation cycle 150 may comprise looping back to step 114, as illustrated in FIG. 6.

Figure 7:
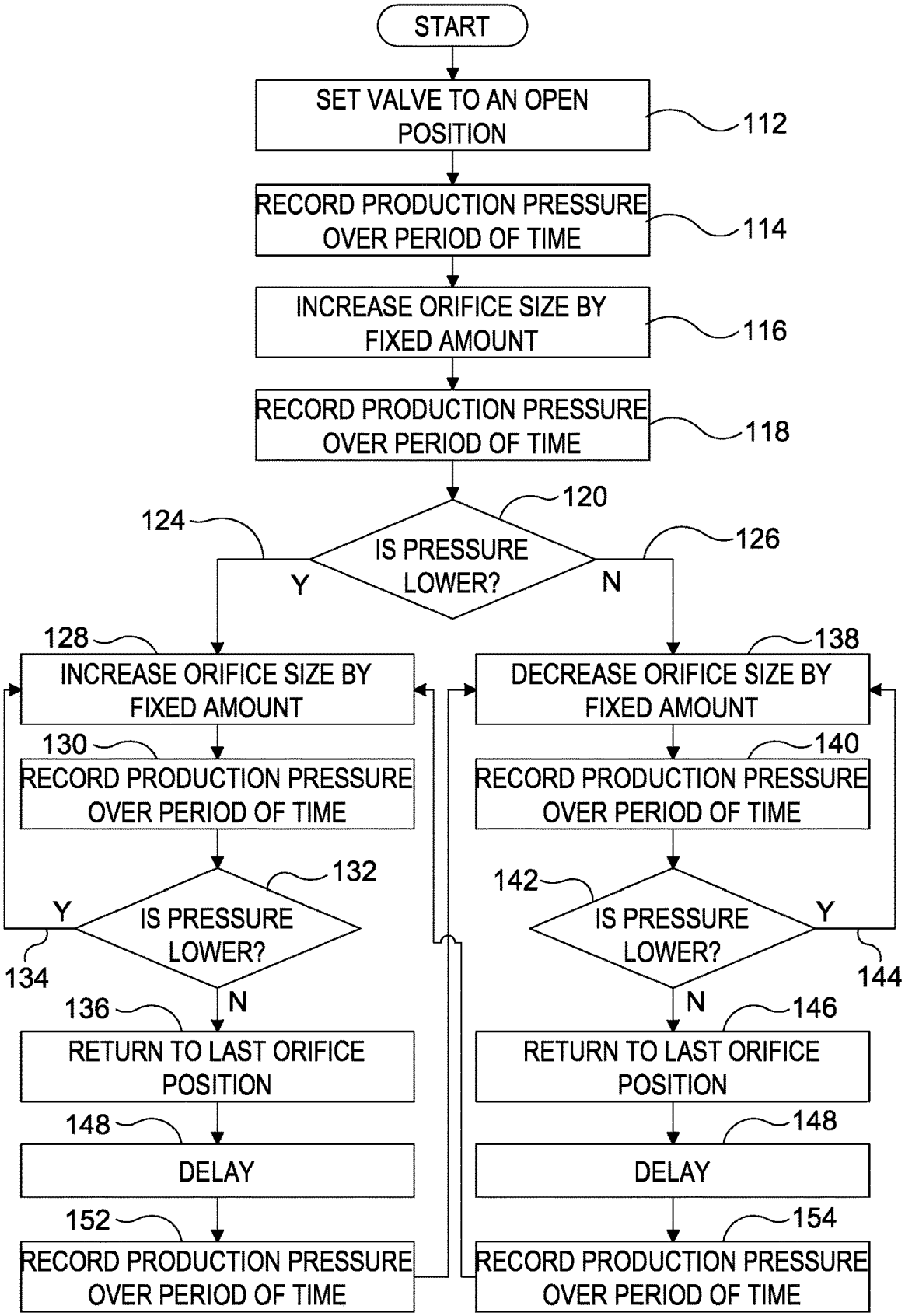

Alternatively, as shown in FIG. 7, the optimisation cycle may involve a continuous loop which permits the valve 10 to autonomously increase and decrease the orifice size in a cycling manner to seek to maintain an optimum setting. In the case that an optimised setting has been achieved at step 136, by a process of increasing the orifice size, for example progressively increasing in multiple loops 134, then following a period of delay 148 the production pressure may be recorded over a period of time at step 152, and the process then looping to step 138. In the case that an optimised setting has been achieved at step 146, by a process of decreasing the orifice size, for example progressively decreasing in multiple loops 144, then following a period of delay 148 the production pressure may be recorded over a period of time at step 154, and the process looping to step 128.

Figure 6:
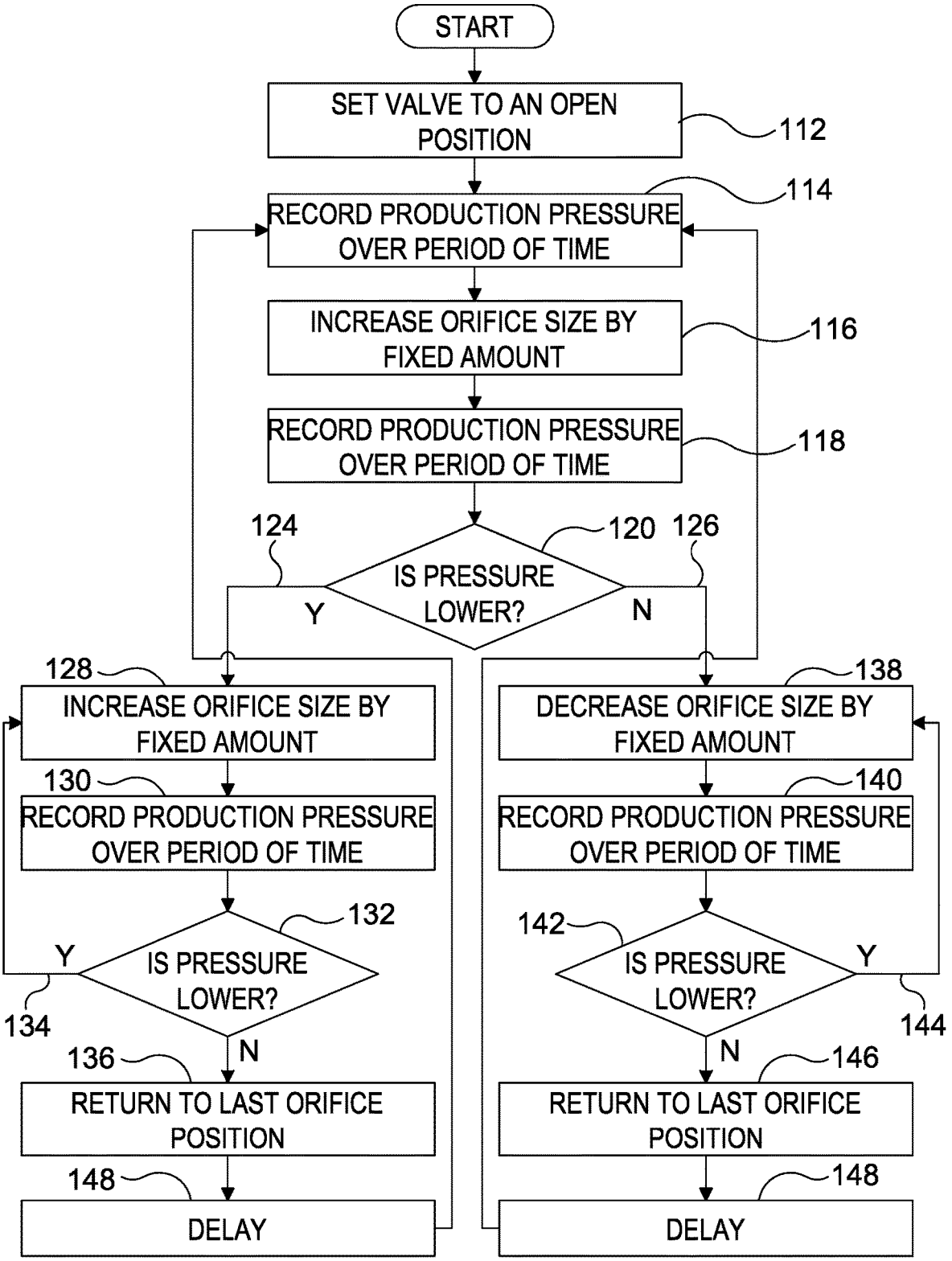

In the process of FIGS. 5, 6 and 7 the orifice size is increased at step 116 from an initial open position at step 112. However, in alternative embodiments the orifice size may be initially decreased from the initial open position of step 112, and the process of FIGS. 5, 6 and 7 modified accordingly.

Figure 8:
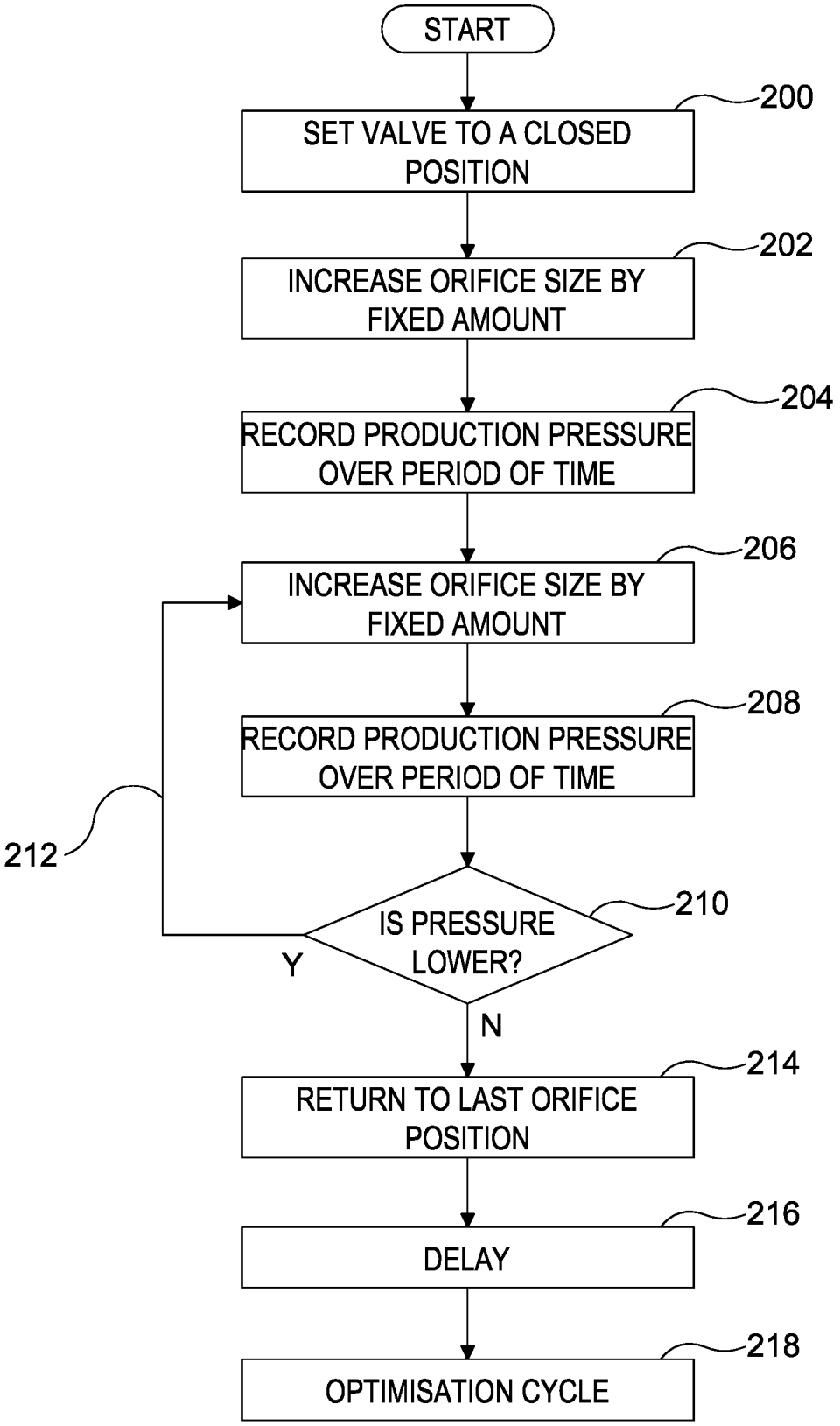

FIG. 8 diagrammatically illustrates a process or method for autonomously controlling the valve 10 in a learning mode of operation in accordance with a further embodiment of the invention. In this case the process starts with the valve 10 set to a fully closed position at step 200, and the orifice size increased by a fixed amount at step 202, with production pressure then determined over a period of time (e.g., for stabilisation) at step 204. The orifice size is increased by a fixed amount at step 206, and production pressure again determined at step 208. It is then determined at step 210 whether or not the recorded production pressure at step 208 is lower than the previous recorded production pressure (in this first process run at step 204). If an affirmative determination is made at step 210, a looped process 212 is followed, such that the process loops back to step 206. If a negative determination is made the process moves to step 214 at which the orifice is set to its previous position (or alternatively may be retained at the current position). At this stage the valve 10 may be considered to have reached an optimised position.

The determination at step 201 is whether the previous change has made the pressure lower. However, in an alternative embodiment the determination may be whether the pressure variation (first derivative) achieved by the previous change is below a threshold value.

In some embodiments the process may end at step 214. However, as illustrated, an optimisation cycle may be run at step 218 following a delay step 216, to seek to maintain a suitable optimised valve setting. Such an optimisation cycle 218 may include progressive adjustments to the orifice size (larger and/or smaller), and measuring production pressure to assist in making a determination as to whether optimisation has been achieved/maintained.

In FIG. 8 the process is initiated with the valve initially closed, and progressively opened to find an orifice size which achieves a minimum production pressure. However, in other embodiments (not illustrated), the valve may be initially fully opened, and progressively closed to find an orifice size which achieves a minimum production pressure.

Figure 9:
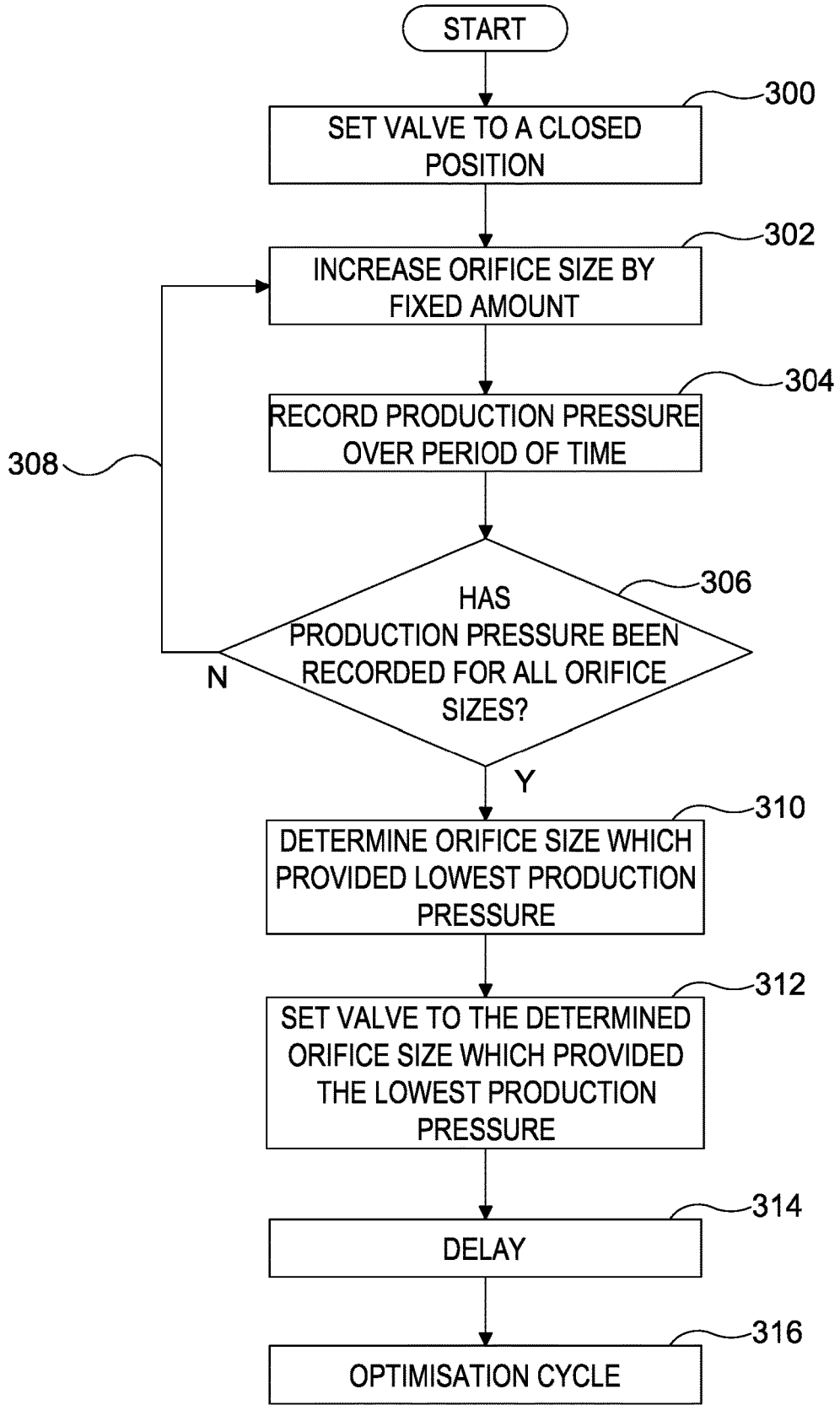

FIG. 9 diagrammatically illustrates a process or method for autonomously controlling the valve 10 in a learning mode of operation in accordance with a further embodiment of the invention. In this embodiment the valve is initially set to a closed position at step 300, and the orifice size increased by a fixed amount at step 302 with production pressure subsequently determined at step 304. It is then determined at step 306 is production pressure has been recorded for every orifice size (for example for a finite number of incremental orifice sizes). If the determination is negative the process follows loop 308, returning to step 302 to further increase the orifice size and determine the associate production pressure. When the production pressure is recorded for every incremental orifice size then the determination at step 306 is affirmative, and the process moves to step 310 at which it is determined which orifice size provided the lowest production pressure, following which the valve is set, at step 312, to the determined orifice size. The determined production pressure relative to various orifice sizes may be graphically represented as in FIG. 4, with the aim of seeking to set the orifice at point 110. At this stage the valve 10 may be considered to have reached an optimised position.

In some embodiments the process may end at step 312. However, as illustrated, an optimisation cycle may be run at step 316 following a delay step 314, to seek to maintain a suitable optimised valve setting. Such an optimisation cycle 316 may include progressive adjustments to the orifice size (larger and/or smaller), and measuring production pressure to assist in making a determination as to whether optimisation has been achieved/maintained. Alternatively, the process may loop back to step 300.

In the embodiment of FIG. 9, the process is initiated with the valve initially closed, and then production pressured determined for multiple orifice sizes to a fully open position. However, in an alternative embodiment (not illustrated), the process may be initiated with the valve initially fully open, and production pressure determined for multiple orifice sizes to a fully closed position.

Figure 10:
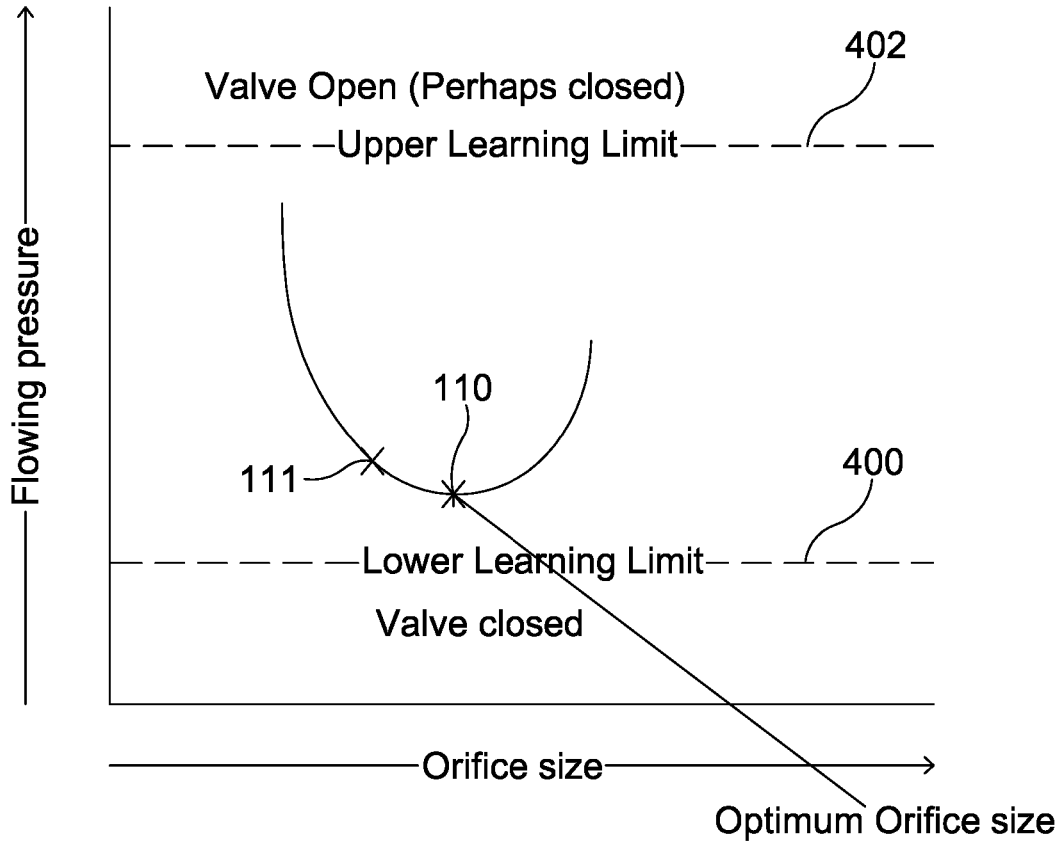
FIG. 10 diagrammatically illustrates an example operational mode of the variable orifice gas lift valve of FIG. 1.

FIG. 10 diagrammatically illustrates an example operational mode or control of the variable orifice gas lift valve 10 of FIG. 1. In this example the valve 10 is controlled such that when it is determined, for example by the controller 52 and pressure sensor 60 (FIG. 2), that the production pressure has fallen below a lower pressure threshold value 400, the valve 10 is autonomously closed. Such an arrangement may thus prevent lift gas being injected, for example as the production pressure may already be at a level, at least at the point of injection, which supports sufficient production rates.

The valve 10 is further controlled such that when it is determined that the production pressure has exceeded an upper pressure threshold value 402, the valve 10 is autonomously fully opened. Such an arrangement may thus recognise a condition at which full flow rate of injection gas is required, without necessarily running through an optimisation procedure which may otherwise drain the battery pack 56. In some instances the valve 10 may alternatively be controlled to fully close when the production pressure exceeds the upper pressure threshold value 402. Such control may be provided in various circumstances, for example to recognise an elevated pressure signal from surface instructing the valve to close, recognising a shut-in condition when gas lift is not required, recognising a different procedure, such as pressure setting remote tools or the like.

When it is determined that the production pressure is between the lower and upper pressure threshold limits 400, 402, the valve 10 may be controlled within a learning mode of operation, such as described in the example embodiments of FIGS. 5 to 9, to seek an optimised valve position (e.g., seeking orifice position 110 or 111. In this arrangement the lower pressure threshold limit 400 may define a lower learning limit, and the upper pressure threshold limit 402 may provide an upper learning limit.

Figure 11:
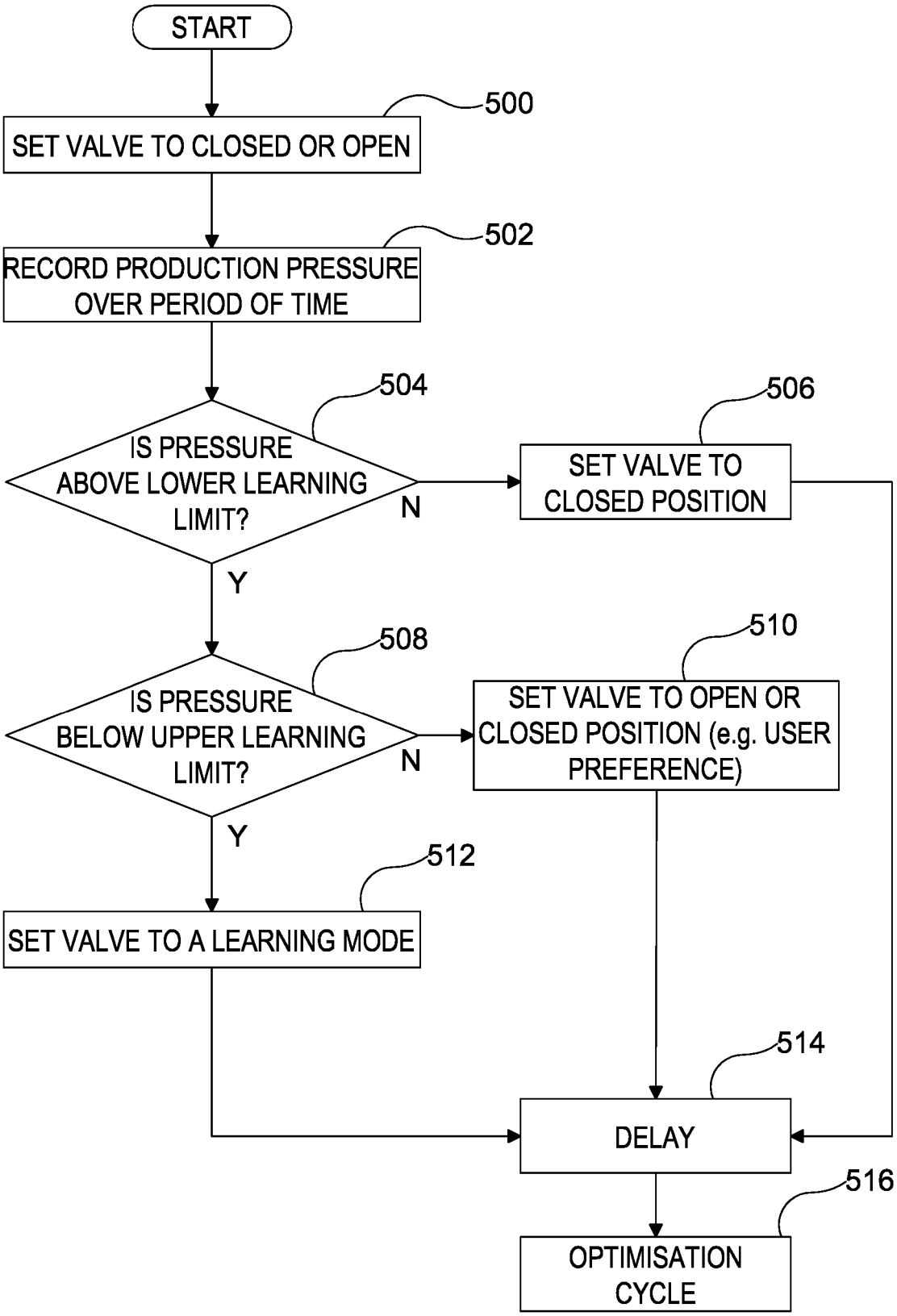
FIG. 11 diagrammatically illustrates an embodiment of a control process or method for controlling the variable orifice gas lift valve of FIG. 1, to achieve the operational mode of FIG. 10.

FIG. 11 diagrammatically illustrates a control process which permits the valve 10 to autonomously operate according to the graphical illustration of FIG. 10. The valve 10 is initially set to either an open or a closed position in step 500. This initial position may be a setting during a prior use of the valve 10, for example following a previous optimised gas lift process. The production pressure is then recorded over a period of time at step 502, and then it is determined at step 504 whether the pressure recorded at step 502 is above the lower learning limit 400 (FIG. 10). If the determination is negative then the valve is set to a closed position in step 506. If the determination at step 504 is affirmative then it is determined at step 508 whether the pressure recorded at step 502 is below the upper learning limit 402 (FIG. 10). If this determination is negative then the valve is set to either a fully open or fully closed position at step 510. If the determination at step 508 is affirmative, then it is considered that the recorded pressure at step 502 is between the lower and upper learning limits 400, 402 (FIG. 10), and the valve 10 can be further controlled in a learning mode of operation at step 512. Such a learning mode of operation may be provided in any required manner, for example as described in the various embodiments of FIGS. 5 to 9.

In some embodiments steps 506, 510 and 512 may each reflect an end of the process. Alternatively, as illustrated in FIG. 11, following a delay step 514, an optimisation cycle step 516 may be followed. Such an optimisation step 516 may loop through the process illustrated in FIG. 11, or alternatively may loop through one or more learning modes.

Figure 12:
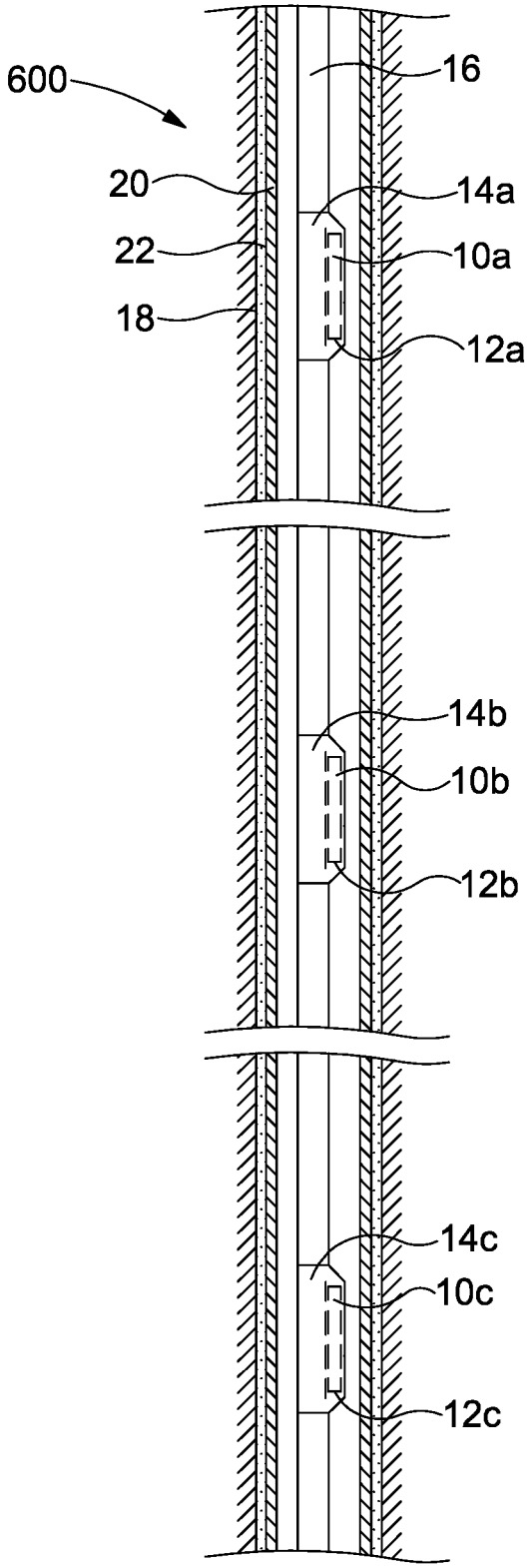
FIG. 12 diagrammatically illustrates a gas injection system which includes multiple variable orifice gas lift valves installed along a production string.

Reference is now made to FIG. 12 in which there is shown a gas lift system, generally identified by reference numeral 600, according to an embodiment of the present invention. The system 600 includes a production string 16 which is mounted within a wellbore 18 lined with a casing or liner string 20 secured via a cement sheath 22, similar to the embodiment of FIG. 1. In this case the production string 16 comprises multiple gas lift mandrels 14*a-c* each including a variable orifice gas lift valve 10*a-c* mounted in respective side-pockets 12*a-c*. More specifically, valve 10*a* is located at an upper region of the production string 16, valve 10*b* is located at an intermediate region, and valve 10*c* is located at a lower region. Each variable orifice gas lift valve 10*a-c* is similar to valve 10 of FIGS. 1 and 2 and as such no further description will be given. The gas lift valves 10*a-c* are autonomously controllable to permit a lift gas injection point to be progressively moved downwardly along the production string 16, initially starting at valve 10*a*, moving to valve 10*b* and then on to valve 10*c*.

In the present embodiment each valve 10*a-c* is configured to be controlled largely in accordance with the operational mode illustrated in FIG. 10. That is, each valve 10*a-c* includes lower and upper pressure threshold limits which dictate an operation of the valves. In the present embodiment, in the event of a production pressure being recorded at the location of a valve 10*a-c* being below the associated valve lower pressure threshold, the valve is autonomously closed. Similarly, in the event of a production pressure recorded at the location of a valve 10*a-c* being above the associated valve upper pressure threshold, the valve is also autonomously closed. When the production pressure at the location of a valve 10*a-c* is between the associated valve upper and lower limits, the valve may be operated to be open, for example in accordance with an appropriate learning or optimisation mode of operation. The pressure variation between the respective upper and lower limits may define an operating pressure window of each valve.

Figure 13:
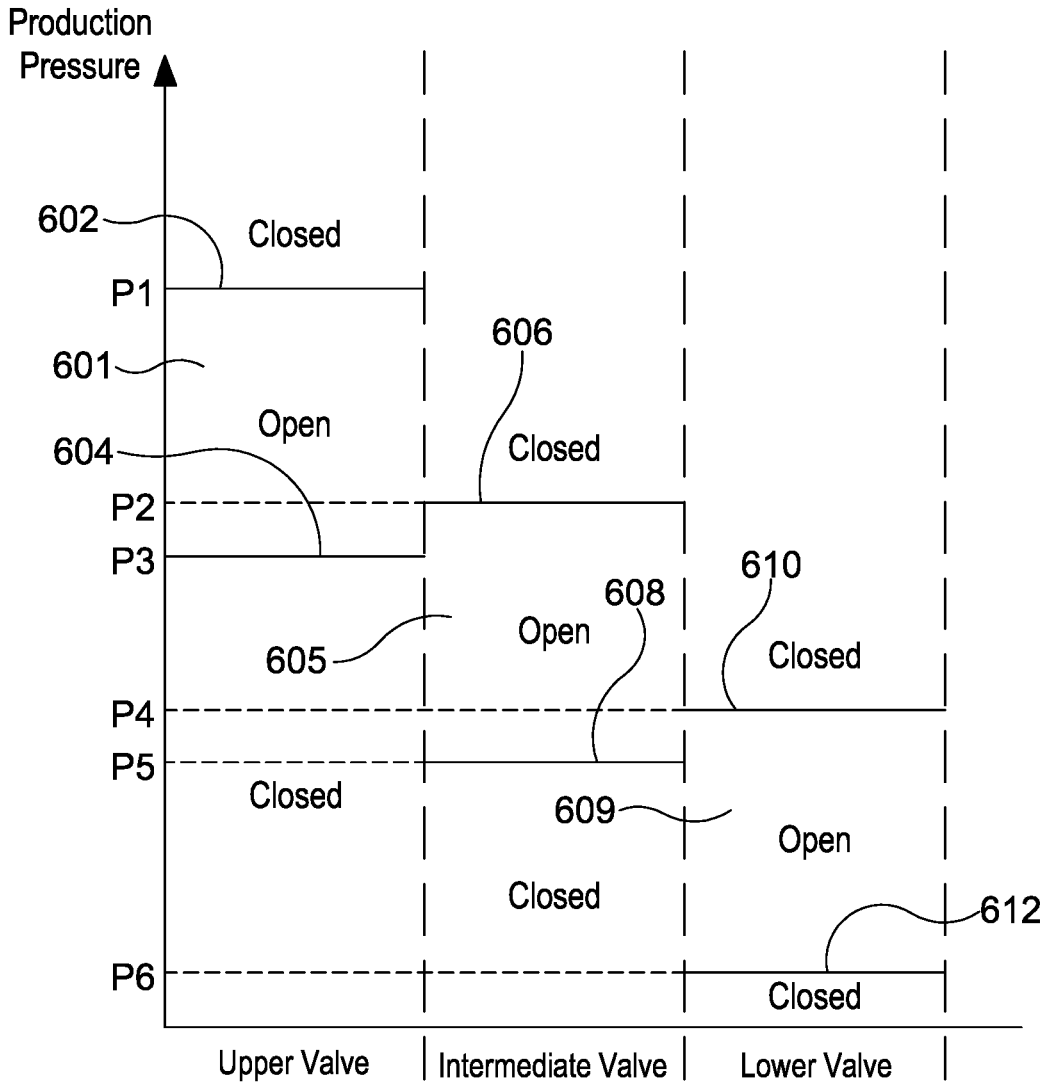
FIG. 13 diagrammatically illustrates operational pressure windows of each valve of FIG. 12.

FIG. 13 graphically illustrates the operating pressure window of each valve. In this case, the upper valve 10*a* defines an operating pressure window 601 between an upper threshold limit 602 at pressure P1 and a lower threshold limit 604 at pressure P3. The intermediate valve 10*b* defines an operating pressure window 605 between an upper threshold limit 606 at pressure P2 and a lower threshold limit 608 at pressure P5. The lower valve 10*c* defines an operating pressure window 609 between an upper threshold limit 610 at pressure P4 and a lower threshold limit 612 at pressure P6. As illustrated, the valves 10*a-c* are only open when the production pressure is within their operating pressure window 601, 605, 609.

As illustrated in FIG. 13, the operating pressure window of two adjacent valves is selected to overlap. Accordingly, at production pressure between pressures P1 and P2 only the upper valve 10*a* will be open. When production pressure falls below pressure P2 (for example by the effect of the gas lift via upper valve 10*a*), the intermediate valve 10*b* will open. When production pressure falls below pressure P3 the upper valve 10*a* will close. Such an overlap in the operating pressure windows 601, 605 of the upper and intermediate valves 10*a*, 10*b* thus permits injection to be continuously provided, allowing one valve to open (in this case valve 10*b*) before another valve closes (in this case valve 10*a*).

When production pressure falls below pressure P4 (for example by the effect of gas injection via intermediate valve 10*b*) the lower valve 10*c* will open, and when production pressure falls below pressure P5 the intermediate valve 10*a* will close.

Accordingly, such an arrangement may permit the gas injection point to be progressively moved in a downhole direction, allowing the gas injection to be provided deeper and deeper into the well, assisting to maximise recovery rates.

In other embodiments additional variable orifice gas lift valves may be provided and arranged along the production string 16. Further, in an alternative embodiment the upper gas lift valve 10*a* may not have an upper pressure threshold limit, such that the upper gas lift valve may be opened at an initial production pressure, to effectively kick-start the gas lift process.

Figure 14:
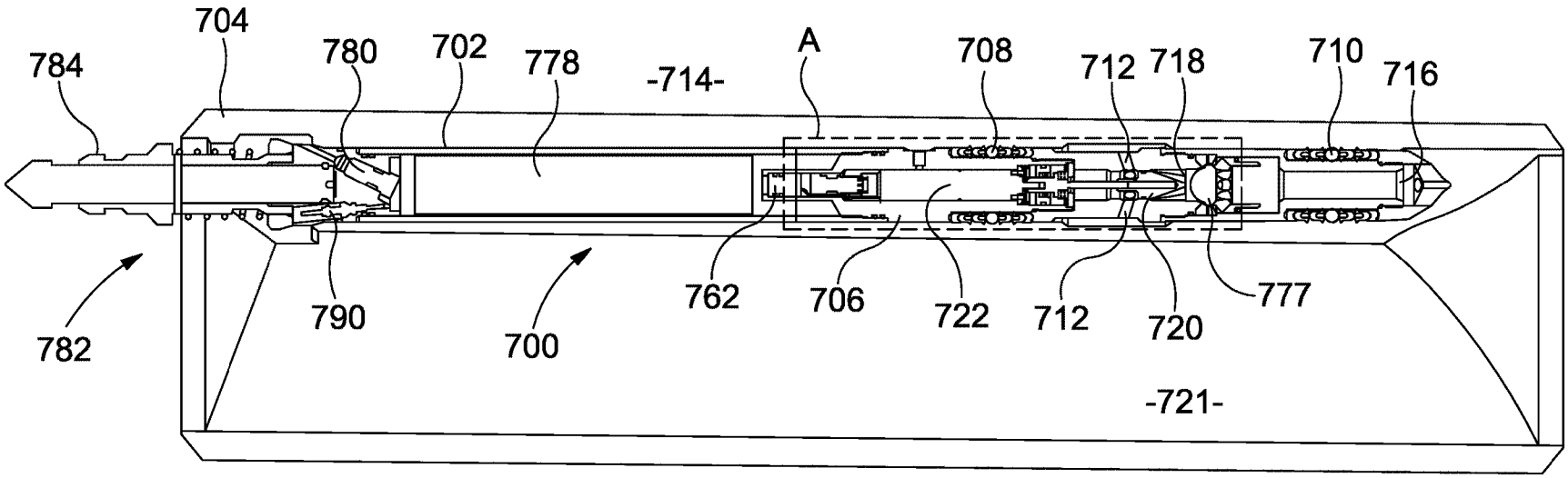
FIG. 14 is a cross sectional view of a valve in accordance with an embodiment of the present invention, illustrated installed within a side pocket of a gas lift mandrel.

A valve, generally indicated by reference numeral 700, is illustrated in cross-section in FIG. 14, reference to which is now made. The valve 700, or features thereof, may be used for any purpose where flow control is required along a flow path. However, for the benefit of the present description the valve 700 is illustrated as a variable orifice gas lift valve 700, and is shown installed within a side pocket 702 of a gas lift mandrel 704 which forms part of a wellbore production string (not shown). The valve 700 may be used or operated in accordance with at least one example presented above.

The valve 700 comprises a housing 706 which is formed to permit installation within the side pocket 702 of the mandrel 704, and carries upper and lower seal stacks 708, 710 on an outer surface of the housing 706 to permit the valve 700 to be sealed within the side pocket 702. The housing 706 includes a plurality of inlet ports 712 extending generally radially through a side wall thereof and which are located intermediate the seal stacks 708, 710. The side pocket 702 also includes a port (not shown) which provides fluid communication with an annulus region 714 surrounding the mandrel 704. Thus, the housing 706 may ultimately be in fluid communication with the annulus 714 via the port in the side pocket 702 and the inlet ports 712.

The housing 706 also includes an outlet port 716 (arranged in an axial direction relative to the housing 706) and a flow path 718 extending between the inlet and outlet ports 712, 716, with a linearly moveable valve member 720 provided within the flow path 718. This arrangement permits fluid (e.g., lift gas) which has been communicated from the annulus region 714 to flow through the valve (under control, as discussed below), to enter a production fluid flow path 721 defined by the mandrel 704. The valve 700 also comprises a check valve 777 for preventing reverse flow into the valve 700 from the production fluid flow path 721.

Figure 15:
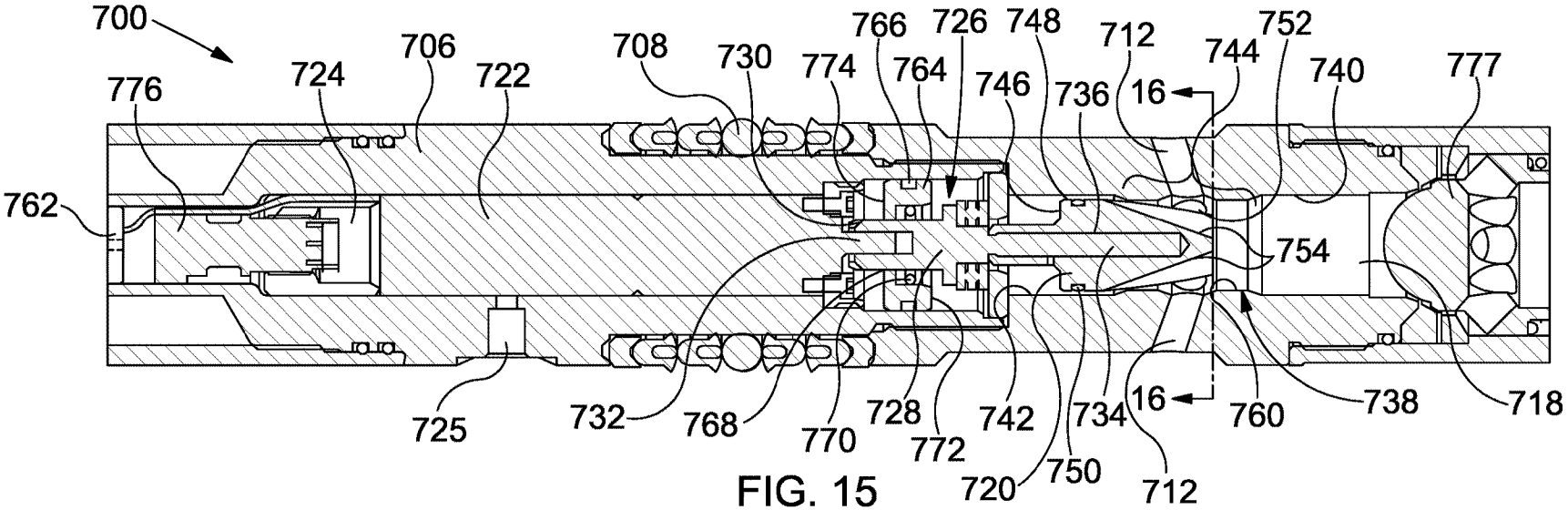
FIG. 15 is an enlarged view of region A of FIG. 14.

An enlarged view of the valve 700 in region A (identified by broken outline in FIG. 14) is illustrated in FIG. 15. The housing 704 is formed of multiple individual components, assembled together to define the complete valve 700, and as described above the valve 700 includes or defines the plurality of inlet ports 712, the outlet port 716, the flow path 718 and the valve member 720 which is linearly moveable within the housing to control flow along the flow path 718. The valve member 720 is illustrated in FIG. 15 in a fully open position which provides a maximum flow area through the flow path 718 (whereas the valve member 720 is illustrated in a fully closed position in FIG. 14, such that the flow path 718 is closed).

The valve 700 further includes a rotary drive, which in the present exemplary embodiment is a stepper motor 722 mounted in an oil-filled chamber 724 formed within the housing 706. Although not shown, the rotary drive may include a gear box or arrangement. The chamber 724 is filled with oil (such as mineral oil) via a port 725 which is subsequently plugged, for example using a threaded plug (not shown). The valve 700 further includes a transmission arrangement 726 interposed between the motor 722 and the valve member 720, wherein the transmission arrangement 726 functions to convert rotary motion of the motor to linear motion of the valve member 720.

In the embodiment illustrated the transmission arrangement 726 includes a drive shaft 728 which includes a first end 730 which is rotatably coupled (e.g., via a hex connection) to a rotary shaft 732 of the motor 722, and a second, threaded end 734 which is threadedly received within a central threaded bore 736 formed in the valve member 720. As will be described in more detail below, the valve member 720 is prevented from rotation relative to the housing 706 such that the rotary motion provided by the motor 722 is converted to linear motion of the valve member 720 by virtue of the threaded connection between the drive shaft 728 and the valve member 720.

The housing 700 defines a bore 738 which includes a flow section 740 which defines the flow path 718. The bore 738 also includes a valve member cavity section 742. In use, the valve member 720 is linearly moved within the bore 738 to be selectively extended into and retracted from the flow section 740 and cavity section 742 to vary the flow path 718.

As noted above, the valve member 720 is prevented from rotation relative to the housing 706. This is achieved by inter-engagement of non-round sections of the housing bore 738 and valve member 720, such that relative rotation is not permitted. Thus, torque applied to the valve member 720 via the drive shaft 728 will be reacted off the housing 706.

Figure 16:
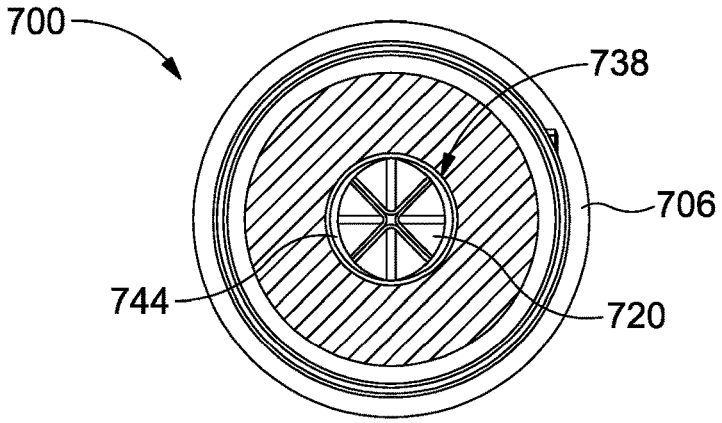
FIG. 16 is a cross-sectional view taken along lines 16-16 of FIG. 15.

With additional reference to FIG. 16, which is a cross-section taken through line 16-16 of FIG. 15, the valve member 720 is non-round, specifically oval in cross section, and at least an intermediate portion 744 of the housing bore 738 (which spans the inlet ports 712 in the present embodiment) includes a corresponding non-round, specifically oval, section. Thus, inter-engagement of the corresponding oval sections prevents the valve member 720 from rotating.

By providing an anti-rotation capability through inter-engagement of the valve member 720 and the housing 706, any required anti-rotation structure associated with the transmission arrangement 726 may be eliminated. For example, the transmission arrangement 726 could otherwise require additional or increased axial length to accommodate a first axial section which includes the threaded drive connection between the drive shaft 728 and the valve member 720, but also a second anti-rotation section, such as might be provided by a key and key-way arrangement. Thus, the present embodiment facilitates a size reduction, contributing to permitting the valve 700 to meet the dimensional constraints dictated by the side pocket 702 of the mandrel 704.

Furthermore, providing the anti-rotation capability through inter-engaging non-round or oval sections of the housing 706 and valve member 720 may facilitate improved and simplified sealing capability therebetween. For example, such inter-engaging oval geometries do not necessitate the use of protrusions and recesses, such as might be required in conventional key and key-way arrangements. Such protrusions and recesses would require complex sealing structures to ensure sealing therebetween.

Figure 17:
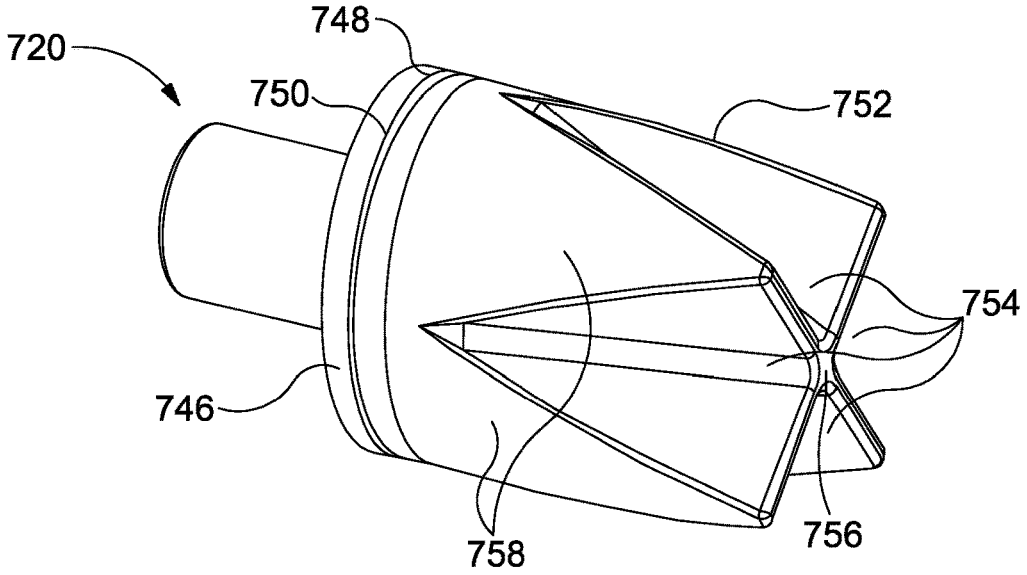
FIG. 17 is a perspective view of a valve member of the valve of FIG. 14.

Reference is now additionally made to FIG. 17, which is a perspective view of the valve member 720 removed from the valve 700. The valve member 720 includes a body section 746 which defines a continuously curved oval surface, with a circumferential recess 748 formed therein to accommodate an O-ring 750. As will be described in more detail below, the O-ring 750 functions to provide sealing with the housing 706, when the valve is in a closed configuration.

The valve member 720 further includes a regulator section 752 which extends axially from the body section 746, wherein the general outer envelope or shape of the regulator section 746 is also oval. The regulator section 752 comprises a plurality of recesses 754 (four in the present embodiment), which increase in depth and circumferentially widen from the body section 746 to a tip 756 of the valve member 720. The recesses 754 thus define interspersed rib sections 758

(four in the present embodiment), wherein each rib section 758 defines a portion of the oval shape of the valve member 720.

When the valve member 720 is in its fully open position, as shown in FIG. 15, the regulator section 752 of the valve member 720 partially extends into the flow path 718, extending adjacent the inlet ports 712, such that the general oval shape of the regulator section 752 engages the oval shape of the bore section 744, thus preventing rotation of the valve member 720.

The recesses 754 function to establish a desired restriction in the flow area, with the specific form of the recesses 754 being such that linear movement of the valve member 720 into the flow path 718 causes an increasing reduction in the flow area. Accordingly, the flow area, and thus orifice size and flow rate of the valve 700 may be adjusted by selective positioning of the valve member 720. Such controlled movement of the valve member 720 may facilitate operation of the valve 700 in accordance with one or more of the embodiments previously described.

Further, the increasing depth of the recesses 754 provides a generally tapering structure which assists to divert incoming flow (e.g., a lift gas) into alignment with a central axis of the flow path 718. This may minimise turbulence within the incoming flow, and may reduce any jetting/stagnation of the incoming flow against opposing surfaces of the housing bore 738, which may otherwise cause erosion, establish undesired flow conditions and the like.

Figure 18:
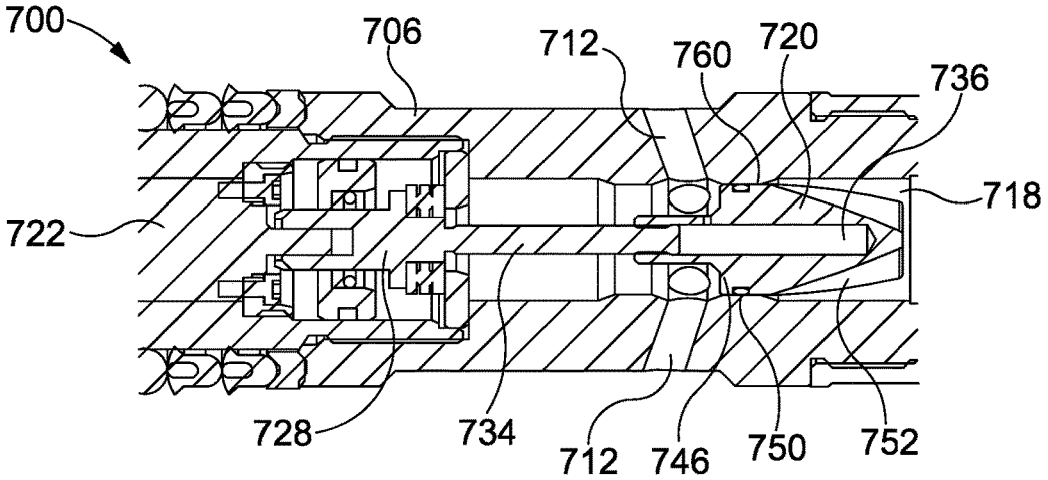
FIG. 18 is an enlarged view of the valve in the region of a valve member, with the valve member illustrated in a closed configuration.

When the valve member 720 is moved to its fully closed position, as illustrated in FIG. 18, the body section 746 becomes received within a sealing bore section 760 of the housing bore 738 (positioned downstream of the inlet ports 712), such that the O-ring 750 provides sealing between the valve member 720 and housing 706, thus closing the flow path 718 and preventing flow. It should be noted that such sealing between the valve member 720 and the housing 706 is only achieved when in the illustrated closed configuration. At all other positions sealing is prevented, for example due to enlarged bore sections, axial channels, striations and/or the like. Such an arrangement may minimise the risk of hydraulic locking of the valve member 720 during movement within the housing 706.

Referring again to FIG. 15, as noted above the motor 722 is mounted within an oil-filled chamber 724. The chamber 724 is closed at its upper end by a plug 762 (partially shown in FIG. 15, but illustrated in its entirety in FIG. 14), and at its lower end by a pressure transfer member in the form of an annular balance piston 764. The balance piston 764 is moveably mounted within the housing 706 and includes an outer sliding seal 766 which provides a dynamic seal between the housing 706 and balance piston 764. The balance piston 764 also includes a central bore 768, through which bore 768 the drive shaft 728 extends. A linear/rotary seal 770 is provided between the drive shaft 728 and balance piston 764. Thus, the oil-filled chamber 724 may be sealingly isolated from the bore 738 of the housing 706, and thus from the fluid (e.g., lift gas) passing through the valve 700.

The balance piston 764 functions to ensure the pressure within the chamber 724 substantially matches, balances or tracks the pressure within the housing bore 738, which may be deemed equivalent to the injection fluid pressure of the annulus region 714 surrounding the mandrel 704 (see FIG. 14). Specifically, a first side 772 of the balance piston 764 is exposed to fluid within the housing bore 738, and an opposing second side 774 of the piston 764 is exposed to oil within the chamber 724, such that the balance piston 764 will be caused to move linearly within the housing in response to any developed pressure differential across the first and second sides 772, 774, until pressure equilibrium is achieved. In some unillustrated embodiments a biasing arrangement (e.g., a spring) may also add a bias force to the balance piston 764 to maintain the chamber pressure a predetermined value above or below the pressure in the housing bore 738.

The balance piston 764 may thus advantageously provide a dual function: the first to act as a pressure bulkhead with ability to accommodate a rotary shaft extending therethrough; and the second to enable pressure balancing of the chamber 724 relative to an external location. The balance piston arrangement may have application in any apparatus, and is not strictly limited for use with the illustrated valve 700.

The presence of the oil filled chamber 724 may advantageously provide a clean working environment for the motor 722, while pressure balancing this chamber 724 may minimise the pressure differential requirements for the seals 766, 770.

Referring still to FIG. 15, the valve 700 further comprises a first pressure sensor 776 mounted within the oil-filled chamber 724 and configured for sensing pressure within said chamber 724. As the chamber 724 is pressure balanced with the housing bore 738 which may be considered to be substantially equivalent to the pressure within the wellbore annulus 714 (FIG. 14), the first pressure sensor 776 may thus ultimately be used to sense/determine annulus/injection pressure. Such sensing may be achieved without exposing the sensor directly to the fluid (e.g., lift gas) flowing through the valve 700, which may provide protection to the first sensor 776. Further, such sensing may eliminate or minimise the requirement to position a sensor with the annulus 714 (FIG. 14). The pressure data obtained from the first sensor 776 which is associated with the fluid injection pressure may be used as part of a control process for operating the valve 700. For example, the determined pressure may provide an input to an autonomous control algorithm, may provide a control signal from surface and the like.

The valve 700 further includes a number of components in common with valve 10 shown in FIG. 2. For example, and with reference to FIG. 14, the valve 700 includes an electronics module 778 which includes a controller coupled to the motor 722 and configured to operate in accordance with installed process instructions or algorithms, to effect suitable control, for example autonomous control, of the valve 700. The electronics module 778 may also include memory which may contain suitable process instructions or algorithms to be used by the controller to facilitate control of the valve 700. The electronics module 778 may also comprise a power source such as a battery pack.

Further, the valve 700 includes a second pressure sensor 780 which is arranged to sense pressure within the production flow path 721 of the mandrel 704, which thus allows production pressure to be determined. The second pressure sensor 780 is in communication with the controller of the electronics module 778 such that the controller may utilise the pressure data to facilitate control of the valve.

An upper end 782 of the valve 700 comprises a connector assembly 784 for permitting connection with a deployment/retrieval tool (not shown), such as a wireline kick-over tool.

The valve 700 further includes a communication port or connector 790 which facilitates communication between the electronics module 778 and external equipment. For example, the port or connector 790 may allow the electronics module 778 to be appropriately loaded or programmed with the necessary algorithms, permit testing or interrogation of the electronics module 778, for example to determine that the correct algorithm is loaded, to permit charging of batteries, and the like. The communication port or connector 790 may permit connection while the valve 700 is in situ, for example by stabbing in using intervention equipment deployed downhole. Alternatively, or additionally, the communication port or connector 790 may facilitate connection while the valve 700 is located at surface, for example at a manufacture location, on a rig environment, for example prior to valve deployment, and the like.

Figure 19:
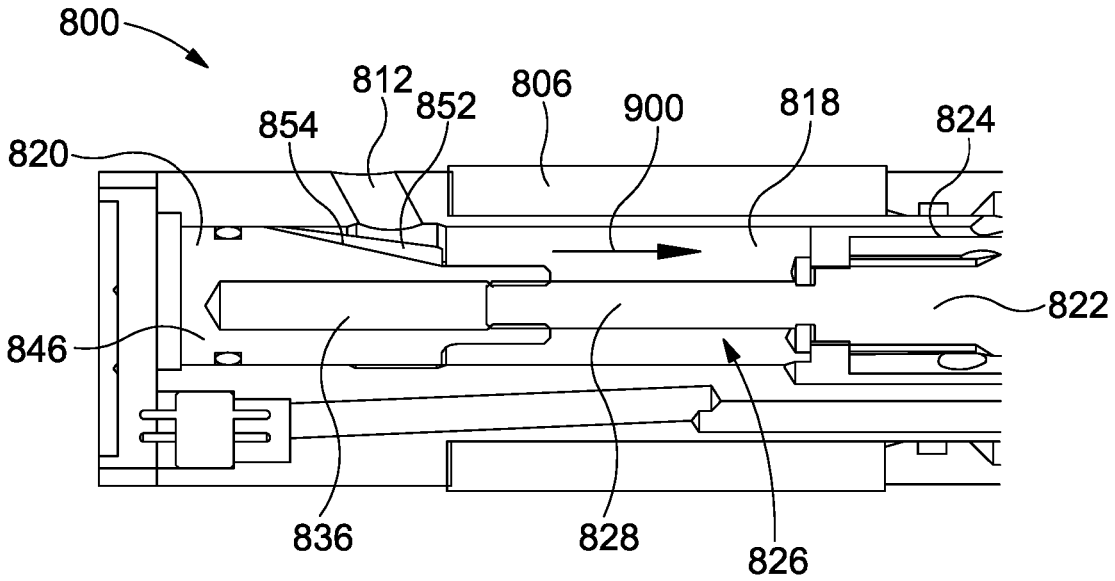
FIG. 19 is a diagrammatic illustration of a portion of a valve in accordance with an alternative embodiment.

As defined above, the valve 700 is formed and arranged such that the valve member 720 is prevented from rotation relative to the valve housing 706 by virtue of corresponding non-round valve member and housing sections. However, other arrangements are possible. One such exemplary alternative is illustrated in FIG. 19, reference to which is now made, wherein FIG. 19 is a diagrammatic cross-sectional view of a portion of a valve, generally identified by reference number 800. The valve 800 is similar in many respects to valve 700 first shown in FIG. 14, and as such like features share like reference numerals, incremented by 100.

The valve 800 includes a housing 806 which includes an inlet port 812 extending generally radially through a side wall thereof. The housing 806 also includes an outlet port (not shown in FIG. 19) and a flow path 818 extending between the inlet port 812 and outlet, with a linearly moveable valve member 820 provided within the flow path 818. This arrangement permits fluid (e.g., lift gas) to flow through the valve 800, in the direction of arrow 900 under control dictated by the position of the valve member 820. The valve member 820 is illustrated in a fully open position in FIG. 19.

The valve member 820 is similar in form and function to valve member 720 described above, and includes a body section 846 and a regulator section 852, wherein the regulator section 852 includes a tapering recess 854. However, in the present embodiment the valve member 820 is generally round or circular in cross-section.

The valve 800 further includes a rotary drive 822, and a transmission arrangement 826 extending between the rotary drive 822 and the valve member 820. In the present embodiment the rotary drive 822 is mounted within a chamber/internal housing 824 which is mounted within the flow path 818. The transmission arrangement 826 includes a drive shaft 828 which extends from the rotary drive 822 and is threadedly engaged within a threaded bore 836 in the valve member 820. In the present embodiment the threaded bore 836 is off-centre or non-concentric with the central axis of the valve member 820. This arrangement thus prevents the drive shaft 828 from imparting torque to the valve member 820, thus preventing any rotation of the valve member 820 relative to the housing 806. Accordingly, rotary motion of the rotary drive 822 may be converted to linear motion only of the valve member 820.

It should be understood that the embodiments described herein are merely exemplary and that various modifications may be made thereto without departing from the scope of the invention. For example, in some embodiments temperature measurements may be made, and temperature data used in the control process. Also, in some embodiments flow rate may be measured. Also, in applications using multiple valves, each valve may operate independently, or may communicate with one or more other valves, for example by utilising data associated with one or more other valves.

The invention claimed is:

1. A method for injection of a lift gas from an annulus of the wellbore into a wellbore production string, the method comprising:

determining production pressure within the production string; and autonomously controlling a variable orifice gas lift valve disposed in the wellbore on the production string in accordance with the determined production pressure, wherein the variable orifice gas lift valve controls an injection flow rate of the lift gas from the annulus into the production string, wherein autonomously controlling the variable orifice gas lift valve comprises:

operating the variable orifice gas lift valve in a learning mode of operation to determine a setting of the variable orifice gas lift valve which provides a target production pressure or pressure condition, the pressure condition comprising a substantially minimum production pressure; and subsequently operating the variable orifice gas lift valve in an operational mode of operation in which the variable orifice gas lift valve remains at a position previously determined during the learning mode of operation; and wherein determining the setting of the gas lift valve in the learning mode of operation comprises at least one of:

determining the production pressure with the gas lift valve set at multiple positions, and then selecting the setting of the gas lift valve which provides the target production pressure or pressure condition; and setting the gas lift valve at different incremental positions between a fully closed state and a fully open state, and determining the valve position which provides a lowest or minimized production pressure.

2. The method of claim 1, wherein the lift gas in the annulus of the wellbore is from: a source located at a surface position, a source located at a downhole position, or a gas-bearing subterranean formation.

3. The method according to claim 1, wherein the variable orifice gas lift valve comprises:

a pressure sensor, and the method comprises determining the production pressure using said pressure sensor; and a controller, and the method comprises controlling the variable orifice gas lift valve using said controller.

4. The method according to claim 1, comprising switching between the learning and operational modes of operation to define an optimization cycle.

5. The method according to claim 1, comprising:

determining a first production pressure value with the gas lift valve set to a first position;

determining a second production pressure value with the gas lift valve set to at least one further position; and using the determined first and second production pressure values to control the gas lift valve to be set to an operational position which provides the target production pressure or condition.

6. The method according to claim 5, wherein the operational position comprises the first position or the at least one further position.

7. The method according to claim 1, comprising:

setting the variable orifice gas lift valve to a first position which provides a first injection flow rate value of the lift gas, and determining a first production pressure value;

setting the variable orifice gas lift valve to a second position which provides a second injection flow rate value of the lift gas which is different from the first injection flow rate value, and determining a second production pressure value; and controlling the variable orifice gas lift valve to be set to an operational position in accordance with the first and second determined production pressure values.

8. The method according to claim 7, comprising controlling the variable orifice gas lift valve to be set to one of the first and second positions which provides the lowest or minimized production pressure.

9. The method according to claim 7, comprising:

controlling the variable orifice gas lift valve, in accordance with the first and second determined production pressure values, to be set to a third position which provides a third injection flow rate value of the lift gas which is different from the first and second injection flow rate values, and determining a third production pressure value; and controlling the variable orifice gas lift valve in accordance with at least one of the first, second, and third determined production pressure values.

10. The method according to claim 9, wherein the third position is determined in accordance with an increase or decrease in pressure between the first and second determined production pressure values.

11. The method according to claim 9, wherein the variable orifice gas lift valve is controlled to be set to the first, second or third position which provides the lowest or minimized production pressure.

12. The method according to claim 1, comprising:

setting the valve at a first position and recording a first production pressure value;

setting the valve at a second position and recording a second production pressure value;

determining a first pressure variation between the first and second production pressure values; and controlling the valve in accordance with the first pressure variation.

13. The method according to claim 12, comprising controlling the valve to at least one of return to the first position or remain at the second position when the first pressure variation falls below a threshold value, wherein the threshold value defines a first derivative threshold value.

14. The method according to claim 13, wherein if the first pressure variation is above the first derivative threshold value, the method comprises:

controlling the valve to be set to a third position and recording a third production pressure value;

determining a second pressure variation between the second and third production pressure values; and controlling the valve in accordance with the second pressure variation.

15. The method according to claim 13, comprising sequentially controlling the valve to be set to further positions and determining further pressure variations until such time as the first derivative threshold is reached.

16. The method according to claim 1, comprising controlling the variable orifice gas lift valve to close to prevent flow of the lift gas when it is determined that the production pressure is lower than a lower threshold level.

17. The method according to claim 16, wherein when it is determined that the production pressure is above the lower threshold level, the method comprises controlling the gas lift valve to define a desired injection flow rate value of the lift gas in accordance with the production pressure.

18. The method according to claim 17, comprising operating the variable orifice gas lift valve in the learning mode of operation when the production pressure is determined to be above the production pressure lower threshold level, such that the lower threshold level defines a lower learning limit.

19. The method according to claim 16, comprising controlling the variable orifice gas lift valve to at least one of fully closed or fully open when it is determined that the production pressure is higher than an upper threshold level.

20. The method according to claim 19, wherein when it is determined that the production pressure is lower than the production pressure upper threshold level, the method comprises controlling the gas lift valve to define a desired injection flow rate value of the lift gas in accordance with the production pressure.

21. The method according to claim 20, comprising operating the variable orifice gas lift valve in the learning mode of operation when the production pressure is determined to be lower than the upper threshold level, such that the upper threshold level defines an upper learning limit.

22. The method according to claim 21, comprising operating the variable orifice gas lift valve over a production pressure window defined between lower and upper production pressure threshold limits.

23. A gas lift valve to inject a lift gas from an annulus of a wellbore into a production string, the gas lift valve comprising:

a valve inlet for communicating with the lift gas in the annulus and a valve outlet for communicating with a production string;

a variable orifice positioned between the valve inlet and valve outlet; and a controller configured to receive data associated with production pressure and control the variable orifice in accordance with said production pressure to control an injection flow rate of the lift gas from the annulus into the production string, wherein the controller is configured to:

operate the variable orifice gas lift valve in a learning mode of operation to determine a setting of the variable orifice gas lift valve which provides a target production pressure or pressure condition, the pressure condition comprising a substantially minimum production pressure; and operate the variable orifice gas lift valve in a subsequent operational mode of operation in which the variable orifice gas lift valve is set at a position previously determined during the learning mode of operation; and wherein to determine the setting of the gas lift valve in the learning mode of operation, the controller is configured to at least one of:

determine the production pressure with the gas lift valve set at multiple positions, and then select the setting of the gas lift valve which provides the target production pressure or pressure condition; and set the gas lift valve at different incremental positions between a fully closed state and a fully open state, and determine the valve position which provides a lowest or minimized production pressure.

24. The gas lift valve of claim 23, wherein the lift gas in the annulus of the wellbore is from: a source located at a surface position, a source located at a downhole position, or a gas-bearing subterranean formation.

* * * * *